US012024902B2

(12) United States Patent
Mineo et al.

(10) Patent No.: US 12,024,902 B2
(45) Date of Patent: Jul. 2, 2024

(54) TAPELESS FASTENING AND FINISHING SYSTEM FOR WALLBOARD INSTALLATION

(71) Applicant: TRUE CORNERS, LLC, Osprey, FL (US)

(72) Inventors: Charles W. Mineo, Ft. Lauderdale, FL (US); Samuel J. Mineo, Osprey, FL (US); Mark F. Mineo, Annapolis, MD (US)

(73) Assignee: TRUE CORNERS, LLC, Osprey, FL (US)

( * ) Notice: Subject to any disclaimer, the term of this patent is extended or adjusted under 35 U.S.C. 154(b) by 190 days.

(21) Appl. No.: 17/431,415

(22) PCT Filed: Feb. 14, 2020

(86) PCT No.: PCT/US2020/018444
§ 371 (c)(1),
(2) Date: Aug. 16, 2021

(87) PCT Pub. No.: WO2020/168301
PCT Pub. Date: Aug. 20, 2020

(65) Prior Publication Data

US 2022/0120097 A1 Apr. 21, 2022

Related U.S. Application Data

(60) Provisional application No. 62/806,555, filed on Feb. 15, 2019.

(51) Int. Cl.
*E04F 19/06* (2006.01)
*E04F 19/02* (2006.01)

(52) U.S. Cl.
CPC ..... *E04F 19/064* (2013.01); *E04F 19/024* (2013.01)

(58) Field of Classification Search
CPC ..... E04F 19/061; A47G 27/0268
See application file for complete search history.

(56) References Cited

U.S. PATENT DOCUMENTS 3,206,806 A 9/1965 Powell
6,745,536 B2 * 6/2004 Tallman ..... E04B 9/241 52/506.07

(Continued)

FOREIGN PATENT DOCUMENTS

EP 2947215 B1 1/2018
WO WO 2014185854 A1 11/2014
WO WO 2019014495 A1 1/2019

OTHER PUBLICATIONS

International Application No. PCT/US2020/018444 International Search Report and Opinion, dated May 4, 2020, 12 pages.

*Primary Examiner* — Patrick J Maestri
(74) *Attorney, Agent, or Firm* — COZEN O'CONNOR

(57) ABSTRACT

A wallboard-fastening device secures first and second wallboards to a framing member without fasteners passing through the wallboards. The device includes first, second, and third framing panels joined along lengthwise edges to form a three-sided cup sized to fit around the framing member, first and second flat-spring flanges joined along lengthwise edges to form a front seam, and a channel-dividing panel joined lengthwise to the front seam and to the second framing panel to form first and second channels that receive the first and second wallboards. The flat-spring flanges flex to exert restoring forces on the wallboards that push the wallboards against the second framing panel. The device may be configured for edge joints, outside-corner joints, and inside-corners, and thus may be combined for any type of wallboard installation, including both parallel and perpendicular applications.

22 Claims, 18 Drawing Sheets

(56) References Cited

U.S. PATENT DOCUMENTS

| | | | | |
|---|---|---|---|---|
| 9,631,377 | B2 * | 4/2017 | Browne | E04F 19/063 |
| 2007/0107348 | A1 | 5/2007 | Browne et al. | |

* cited by examiner

TAPELESS FASTENING AND FINISHING SYSTEM FOR WALLBOARD INSTALLATION

RELATED APPLICATIONS

This application claims priority to U.S. provisional patent application No. 62/806,555, titled "Tapeless Fastening and Finishing System for Wallboard Installation", filed Feb. 15, 2019, the entirety of which is incorporated herein by reference.

BACKGROUND

The goal of a wallboard installation is safe, structurally-sound, durable, and aesthetically-pleasing wall and/or ceiling surfaces in commercial and residential applications.

SUMMARY OF THE EMBODIMENTS

The present embodiments include wallboard-fastening devices and methods that fasten and finish wallboard panels in a wallboard installation. These wallboard-fastening devices include inside-corner fastening devices, outside-corner fastening devices, and middle-seam fastening devices that advantageously serve two important functions for wallboard installations: (1) physically securing, or fastening, wallboards to framing members, and (2) finishing and sealing any gap, joint, or seam between two adjacent wallboard panels. The present embodiments achieve these functions while minimizing common installation errors and/or oversights that occur during installation, and without the need for control joints in continuous wall lengths of 30 feet or more. The present embodiments may be used for either vertical wallboard installations to form interior walls, or horizontal wallboard installations to form interior ceilings. The present embodiments may be used either for parallel applications, where the wallboard edges are parallel to the underlying framing members, or perpendicular applications, where the wallboard edges are perpendicular to the framing members. The present embodiments may be used with either tapered or untapered wallboard panels.

Prior-art wallboard installation methods (e.g., see *Application and Finishing of Gypsum Panel Products*, GA-216-2018, published in 2018 by the Gypsum Association) teach that a wallboard panel is first fastened to a framing member using fasteners that pass through the wallboard panel into the framing member. At the seam, or joint, created where two adjacent wallboard panels abut, "joint tape" is applied over the joint, and a "joint compound" or "mud" is spread or "buttered" over the joint tape on an even plane to finish the joint to a level that is perceptibly smooth relative to the rest of the wallboard surfaces. The joint tape and joint compound should cover fastener heads visible after the wallboard panel is fastened to the framing member so that the fastener heads are not visible after installation. Wallboard accessories such as trim, beads (e.g., corner beads, casing beads), and control joints (i.e. expansion joints) may be used at corners, or in other specific conditions. After the joint compound has dried or cured, sanding (or another type of smoothing) is applied to the dried areas to eliminate high spots and/or excess joint compound. The surface finish may be improved by repeatedly applying joint compound and smoothing the repeatedly-applied joint compound after it has dried.

The present embodiments secure a wallboard panel against a framing element by pressing against an edge of the wallboard continuously along the entire length of the edge, advantageously increasing structural integrity and increasing resistance to shear forces as compared to prior-art installation methods that teach securing a wallboard panel with fasteners placed apart every 16 inches (e.g., as required by some building codes). In fact, the present embodiments do not require any fasteners to pass through the wallboard panel, thereby eliminating the need to cover fastener heads that are visible after fastening with prior-art installation methods. Furthermore, by eliminating fasteners that pass through the wallboard, the present embodiments advantageously avoid several types of installation errors that commonly occur with prior-art methods, such as improperly-installed fasteners that may compromise the strength of the wallboard panel and/or its attachment to the underlying framing member. Examples of improperly-installed fasteners include fasteners of the wrong type, fasteners driven so far into the wallboard panel that they penetrate past the outer paper facing of the wallboard panel, fasteners that are not installed at prescribed distances along the edge of a wallboard panel (e.g., every 16 inches), fasteners that pass too close to an edge of the wallboard panel, and fasteners that are too short to sufficiently penetrate the underlying framing member.

The present embodiments also visibly cover the gap, joint, or seam between two adjacent wallboard panels, advantageously creating a "treated joint" without applying joint tape while avoiding the time-consuming steps of repeated applications of joint compound followed by sanding of each joint compound application. The present embodiments further improve structural integrity and fire safety by avoiding inadequately- and/or inappropriately-applied joint tape and/or joint compound, which frequently hide underlying structural defects or air gaps in the joints The above examples of installation errors are frequently the result of human error, job shortcuts, and/or improper training of wallboard installers (e.g., contractors, laborers). Thus, the present embodiments advantageously speed up installations by simplifying and standardizing the installation, thereby reducing the number of errors and the amount of skill and training needed for wallboard installers. The embodiments also advantageously reduce waste and cost by minimizing materials (i.e., wallboards, joint tape, joint compound) that must be replaced when an installation error occurs, and can reduce job site environmental hazards by eliminating or minimizing harmful airborne dust created by repeated and aggressive sanding of joint compound seams in traditional installations.

Any of the wallboard-fastening device embodiments described herein may be affixed to an underlying framing member with fasteners that, unlike prior-art installation methods, do not require screws, nails or staples to pass through the wallboard panels. Once a wallboard panel is physically secured by insertion of the panel edge into the affixed wallboard-fastening device, the wallboard panel is firmly secured and sealed to the underlying framing member (in a parallel application) continuously along the entire length of the wallboard panel without any joint tape and/or joint compound. In some embodiments, additional fasteners are or may be passed through the wallboard panel to further secure the wallboard panel to the underlying framing member. Furthermore, the present device embodiments, unlike many prior-art installation methods, can be used with industry-standard framing assemblies and configurations without any modification to the standard framing assembly.

In parallel applications of wallboard panels, the present embodiments may advantageously improve fire safety, as compared to prior-art wallboard installation methods, by helping to contain and limit the spread of fire in a building. More specifically, one wallboard-fastening device may fully seal the joint formed by two adjacent wallboard panels against an underlying framing member along the entire length of the joint and framing member, thereby completely blocking air flow through the joint so that air cannot flow from the room in front of the wallboards to the region behind the wallboards, and vice versa. In conjunction with flame-retardant materials commonly used in wallboard panels, the present embodiments, which have been certified through Underwriter's Laboratories to achieve a Class A rating for fire and smoke spread, limit oxygen-fueled growth of a fire, preventing the fire from spreading from one room of the building to another (or at least slowing the growth and spread of the fire, thereby buying valuable time for people to escape the building and/or protecting firefighters by reducing the resulting size and/or intensity of the fire). Note that the present embodiments may be used for all wallboard seams in a room (i.e., both wall seams and ceiling seams), thereby blocking air flow through all such wallboard seams. Such advantages for fire safety cannot be assured using prior art methods in perpendicular applications where the joint may be not fully sealed against the framing member and may not be properly mudded and taped to help avoid the spread of fire by preventing the passage of air through the joint (a joint not backed by a framing member).

Some of the present embodiments include v-springs against which wallboard ends or edges push to implement control joints. The v-springs exert corresponding restoring forces back against the wallboard ends. As each wallboard expands, contracts, and/or shifts, the force exerted by a wallboard panel on the v-springs changes. In response to the changing wallboard force, the v-springs expand and/or contract accordingly so that the corresponding restoring force remains equal and opposite to the wallboard force exerted thereon. By expanding and/or contracting in response to the wallboard force, v-springs help relieve stress on the wallboard panels, thereby preventing cracking of the panels (and/or dried joint compound applied thereon) and increasing resistance to shearing forces. Where an installation uses the present wallboard-fastening devices with v-springs to implement control joints, an architect (or other professional) no longer needs to design and/or specify placement of control joints, advantageously simplifying and speeding-up installation where control joints are advantageous to prevent cracking.

To achieve what is referred to in the art as a level-5 finish (i.e., the level of finish requiring the most labor and skill, often used in high-end residential construction), a wallboard installer using the present embodiments may apply a "skim coat" over the installed wallboard panels and exposed portions of a wallboard-fastening device securing the wallboard panels to an underlying framing member. The skim coat may be applied using joint compound, plaster or any other approved skim coat finish material. The skim coat may be applied directly over the seam formed between an edge of the installed wallboard-fastening device and the visible side of the corresponding installed wallboard panels. The skim coat thus hides the seams without the need for any joint tape and/or previously applied joint compound, achieving in one day what takes several days (i.e., repeated applications of joint compound and sanding) with prior-art wallboard installation methods.

In one embodiment, a wallboard-fastening device for securing first and second wallboards to a framing member includes first, second, and third framing panels joined along lengthwise edges to form a three-sided cup sized to fit around the framing member. The wallboard-fastening device also includes first and second flat-spring flanges joined along lengthwise edges to form a front seam, and a channel-dividing panel joined lengthwise to the front seam and to the second framing panel to form first and second channels that receive the first and second wallboards, respectively. The first and second flat-spring flanges are configured to flex, when the first and second wallboards are inserted into the first and second channels, to exert corresponding first and second restoring forces, on the respective first and second wallboards, that push the first and second wallboards against the second framing panel.

In another embodiment, a wallboard-fastening device for securing first and second wallboards to a framing member in an outside-corner configuration includes first, second, and third framing panels joined along lengthwise edges to form a three-sided cup sized to fit around the framing member, wherein the first and second framing panels form a framing seam where their lengthwise edges are joined. The wallboard-fastening device also includes first and second corner panels, wherein a first lengthwise edge of the first corner panel is joined perpendicularly to a first lengthwise edge of the second corner panel. The wallboard-fastening device also includes first and second bridge panels, wherein: (1) a first lengthwise edge of the first bridge panel is joined perpendicularly to a second lengthwise edge of the first corner panel to form a first outer seam, (2) a first lengthwise edge of the second bridge panel is joined perpendicularly to a second lengthwise edge of the second corner panel to form a second outer seam, and (3) a second lengthwise edge of the first bridge panel is joined perpendicularly with a second lengthwise edge of the second bridge panel to form a rear-corner seam that directly coincides with the framing seam of the three-sided cup. The wallboard-fastening device also includes a first flat-spring flange joined lengthwise to the first outer seam such that the first flat-spring flange, the first bridge panel, and the first framing panel form a first channel that accepts the first wallboard. The wallboard-fastening device also includes a second flat-spring flange joined lengthwise to the second outer seam such that the second flat-spring flange, the second bridge panel, and the second framing panel form a second channel that accepts the second wallboard. The first and second flat-spring flanges are configured to flex, when the first and second wallboards are inserted into the first and second channels, such that the first flat-spring flange exerts a first restoring force on the first wallboard to push the first wallboard against the first framing panel, and such that the second flat-spring flange exerts a second restoring force on the second wallboard to push the second wallboard against the second framing panel.

In another embodiment, a wallboard-fastening device for securing first and second wallboards to a framing member in an inside-corner configuration includes first and second framing panels joined perpendicularly along lengthwise edges to form a rear seam. The wallboard-fastening device also includes first and second bridge panels, wherein a first lengthwise edge of the first bridge panel is joined perpendicularly to a first lengthwise edge of the second bridge panel to form a corner seam, a second lengthwise edge of the first bridge panel is joined perpendicularly to the first framing panel away from the rear seam, and a second lengthwise edge of the second bridge panel is joined perpendicularly to the second framing panel away from the rear seam. The wallboard-fastening device also includes a first flat-spring flange joined lengthwise to the corner seam such that the first flat-spring flange, the first bridge panel, and the first framing panel form a first channel that accepts the first wallboard. The wallboard-fastening device also includes a second flat-spring flange joined lengthwise to the corner seam such that the second flat-spring flange, the second bridge panel, and the second framing panel form a second channel that accepts the second wallboard. The first and second flat-spring flanges are configured to flex, when the first and second wallboards are inserted into the first and second channels, such that the first flat-spring flange exerts a first restoring force on the first wallboard to push the first wallboard against the first framing panel, and such that the second flat-spring flange exerts a second restoring force on the second wallboard to push the second wallboard against the second framing panel.

DETAILED DESCRIPTION OF THE EMBODIMENTS

Definitions

Wallboard: a flat panel used for constructing interior walls and ceilings that frequently, although not necessarily, includes gypsum as the base material. The term "wallboard", as used herein, includes drywall, plasterboard, sheet rock, gyprock, gypsum board, backing board, coreboard, greenboard, blueboard, cement board, soundboard, ceiling board, and the like.

Edge: paper-bound edge of a wallboard panel.

End: a face perpendicular to the edge of a wallboard panel.

Framing Member: that portion of framing, furring, bridging, blocking, etc., to which panel products are attached. Wall studs and ceiling joints are examples of framing members. A framing member may be constructed of steel, wood, or another rigid material.

Fastener: nails, screws, or staples used to mechanically affix wallboard panels.

Treated Joint: a joint between wallboard panels that is reinforced and concealed with tape and joint compound, or covered by strip moldings.

Finishing: the act of concealing joints, typically implemented with joint compound and tape; includes concealing fastener heads (when present) and edges or flanges of accessories.

Control Joint: a designed separation between neighboring wallboard panels that allows for movement caused by expansion and/or contraction of wallboard panels, framing members, and/or other components used to fasten and finish the wallboard panels.

Parallel Application: wallboard installation where wallboard panel edges are oriented parallel to framing members.

Perpendicular Application: wallboard installation where wallboard panel edges are oriented perpendicular to framing members.

Embodiments for Edge Joints

Figure 1:
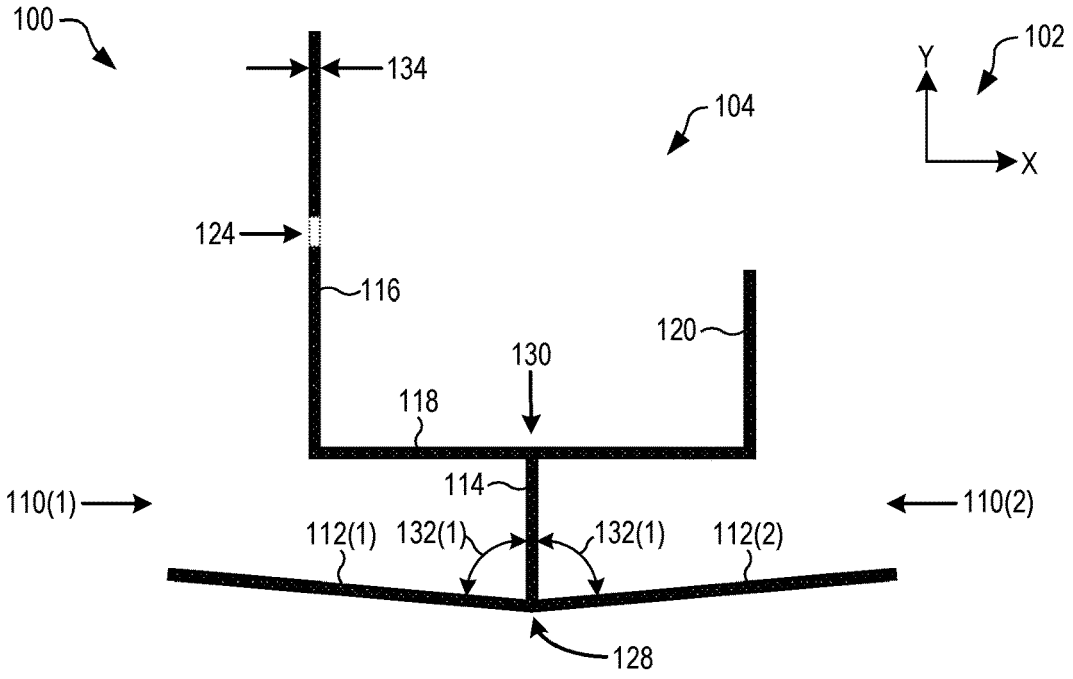
FIG. 1 is an end view of a wallboard-fastening device that secures wallboards to a framing member in a standard edge-joint configuration without fasteners passing through the wallboards, in an embodiment.
Figure 2:
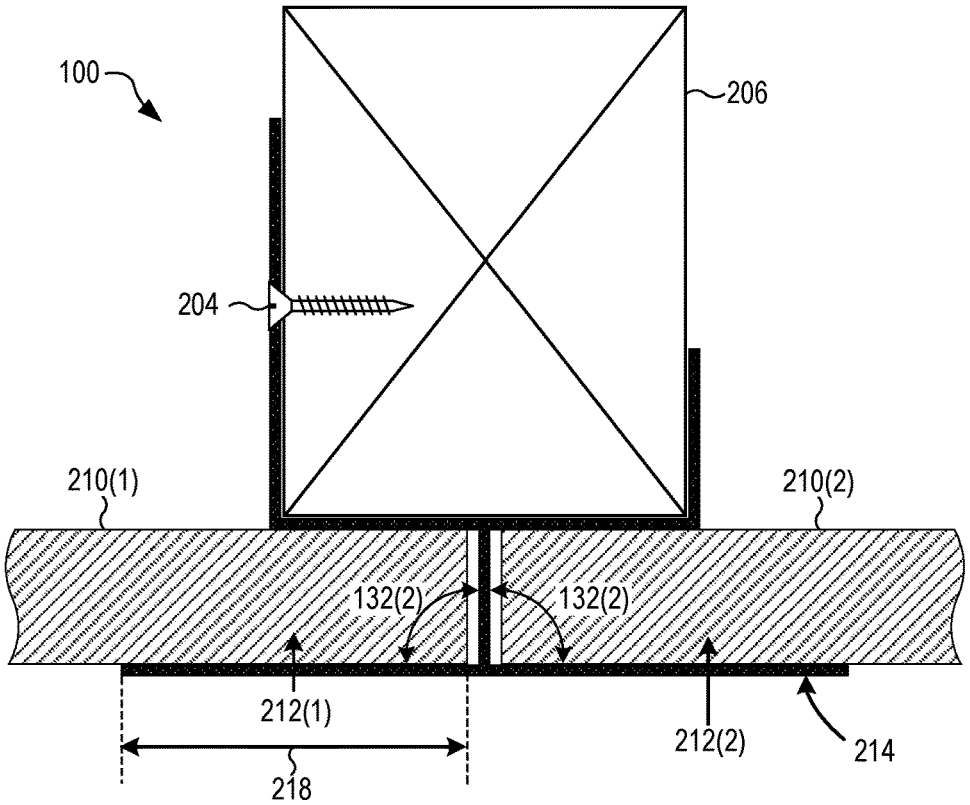
FIG. 2 illustrates the wallboard-fastening device of FIG. 1 securing first and second wallboards to a wall stud in the edge-joint configuration.

FIG. 1 is an end view of a wallboard-fastening device 100 that secures wallboards to a framing member in a standard edge-joint configuration without fasteners passing through the wallboards. FIG. 2 illustrates wallboard-fastening device 100 of FIG. 1 securing first and second wallboards 210(1), 210(2) to a wall stud 206 in the edge-joint configuration. FIGS. 1 and 2 are best viewed together with the following description.

Wallboard-fastening device 100 includes first, second, and third planar framing panels 116, 118, 120 that are joined along lengthwise edges (i.e., in the z direction; see right-handed coordinate system 102) to form a three-sided cup 104 that fits around wall stud 206. Herein, two components are described as "joined" to mean that the two components directly connect to each other without any intervening component (e.g., another planar panel). Wallboard-fastening device also forms first and second channels 110(1), 110(2) that receive first and second wallboards 210(1), 210(2), respectively. First framing panel 116 is joined perpendicularly to a first lengthwise edge of second framing panel 118 to form a right angle. Similarly, third framing panel 120 is joined perpendicularly to a second lengthwise edge of second framing panel 118 to form a right angle. First and third framing panels 116 and 120 are both located on the same side (in the y direction) of second framing panel 118.

As shown in FIG. 2, second framing panel 118 has a width in the x direction that matches a corresponding width of wall stud 206 so that three-sided cup 104 fits around wall stud 206. A width of first framing panel 116 in the y direction is greater than a width of third framing panel 120 in the y direction. Furthermore, a width of each of first and third framing panels 116, 120 is shown in FIG. 2 as being less than a depth of wall stud 206. However, each of first and third framing panels 116, 120 may have a different width than shown in FIGS. 1 and 2. First framing panel 116 may also form one or more fastener holes 124 through which one or more corresponding fasteners 204 may be inserted to secure wallboard-fastening device 100 to wall stud 206. Wallboard-fastening device 100 may be alternatively configured without third framing panel 120, in which case second framing panel 118 need not have a width that matches the width of wall stud 206.

Wallboard-fastening device 100 also includes first and second flat-spring flanges 112(1), 112(2) that are joined along lengthwise edges to form a front seam 128. A planar channel-dividing panel 114 is joined lengthwise to front seam 128 and second framing panel 118 to form first and second channels 110(1), 110(2). In FIGS. 1 and 2, channel-dividing panel 114 directly connects to a midline 130 of second framing panel 118 that is located at a middle of second framing panel 118 in the y-direction. However, channel-dividing panel 114 may directly connect to second framing panel 118 at another location (i.e., a different y coordinate). As shown in FIGS. 1 and 2, channel-dividing panel 114 perpendicularly intersects second framing panel 118 to form two ninety-degree angles with second framing panel 118. However, channel-dividing panel 114 may alternatively intersect second framing panel 118 to form two complementary angles that are not ninety degrees.

Also shown in FIGS. 1 and 2, a width of first flat-spring flange 112(1) is greater than one-half of the width of second framing panel 118, and a width of second flat-spring 112(2) is greater than one-half of the width of second framing panel 118. However, one or both of flat-spring flanges 112 may alternatively have a different width (e.g., less than one-half of the width of second framing panel 118; see FIG. 35).

Flat-spring flanges 112 and channel-dividing panel 114 are joined along lengthwise edges such that channel-dividing panel 114 forms, with each flat-spring flange 112, a nominal angle 132(1) less than ninety degrees. For example, nominal angle 132(1) may be eighty degrees or eighty-five degrees. Thus, each flat-spring flange 112 is not parallel to second framing panel 118 when wallboards 210 are absent from (i.e., not inserted into) channels 110. Furthermore, a width of each channel 110 (in the y direction) is greatest near channel-dividing panel 114, and decreases with increasing distance from channel-dividing panel 114. A width of channel-dividing panel 114 in the y direction may be selected to match a thickness of wallboards 210 (i.e., in the y direction, as shown in FIG. 2). While FIG. 2 shows wallboards 210 as untapered, one or both of wallboards 210 may be tapered.

Flat-spring flanges 112 may be flexed to increase nominal angle 132(1), thereby opening channels 110 to facilitate insertion of wallboards 210 therein. After wallboards 210 have been inserted into channels 210 and flat-spring flanges 112 are released (i.e., no longer actively flexed by an external force), flat-spring flanges 112 come to rest positioned to apply forces 212 of sufficient magnitude to push wallboards 210 against second framing panel 118, thereby physically securing wallboards 210. As shown in FIG. 2, flat-spring flanges 112 come to rest forming a rest angle 132(2) of ninety degrees that is greater than nominal angle 132(1). Furthermore, flat-spring flanges 112 come to rest lying co-planar and parallel to second framing panel 118, thereby ensuring that wallboards 210 are co-planar.

While FIG. 2 shows each force 212 applied at a mid-point (in they direction) of the corresponding flat-spring flange 112, it should be appreciated that forces 212 are distributed along the x direction where flat-spring flanges 112 physically contact corresponding wallboards 210. Thus, in FIG. 2 each force 212 is distributed over a width 218. Furthermore, forces 212 are also distributed along a length (in the z direction) of wallboard-fastening device 100. Therefore, each force 212 is distributed over an area equal to the product of width 218 and the length of wallboard-fastening device 100. In this case, each force 212 exerts a pressure on corresponding wallboard 210. Similarly, each wallboard 210, due to corresponding force 212, pushes against second framing panel 118 over an area, thereby exerting a pressure on second framing panel 118.

Each flat-spring flange 112 may be considered a spring with a spring constant, wherein each force 212 is a spring restoring force. The spring constant, and thus the magnitude of spring restoring forces 212, is determined by a geometry of flat-spring flanges 112 (e.g., thickness and width), nominal angle 132(1), and material properties (e.g., Young's modulus) of the material forming wallboard-fastening device 100. In the small-angle approximation and assuming flat-spring flanges 112 are not flexed beyond their elastic limit, the magnitude of spring restoring forces 212 scales linearly with an angular deviation of angle 132 from the nominal angle shown 132(1) in FIG. 1 (e.g., eighty-five degrees). The material may be plastic, such as PVC plastic, vinyl or another material with which wallboard-fastening device 100 may be manufactured via extrusion. Thus, for a given material, spring-restoring forces 212 may be selected by choosing an appropriate thickness of flat-spring flanges 112 and an appropriate nominal angle 132(1).

The thickness of flat-spring flanges 112 introduces a tradeoff between the magnitude of spring-restoring forces 212 and a distance in the −y direction that outward-facing surfaces 214 of flat-spring flanges 112 protrude relative to wallboards 210. The more that flat-spring flanges 112 protrude away from wallboards 210, the larger the size of a "step" in the y-direction occurring at a distal lengthwise edge of each flat-spring flange 112. Here, the distal lengthwise edge of each flat-spring flange 112 is the lengthwise edge located opposite to the lengthwise edge forming center seam 128. As shown in FIGS. 13-14 and 23-24, the distal lengthwise edge of each flat-spring flange 112 may be tapered to provide a more gradual transition between outward-facing surface 214 of each flat-spring flange 112 and corresponding wallboard 210.

In FIG. 1, first framing panel 116 has a thickness 134 along a direction perpendicular to its width. Although not shown in FIG. 1, each of second framing panel 118, third framing panel 120, channel-dividing panel 114, and flat-spring flanges 112 has a corresponding thickness. In one embodiment, each of first framing panel 116, second framing panel 118, third framing panel 120, channel-dividing panel 114, and flat-spring flanges 112 has a similar thickness (e.g., 1 mm). However, first framing panel 116, second framing panel 118, third framing panel 120, channel-dividing panel 114, and flat-spring flanges 112 may alternatively have different thicknesses.

In one embodiment, nominal angle 132(1) is eighty-five degrees, first framing panel 116 has a width of 30 mm, second framing panel 118 has a width of 44 mm, third framing panel 120 has a width of 10 mm, and each of first and second flat-spring flanges 112 has a width of 15.5 mm. Together, flat-spring flanges 112 span 31 mm, which is less than the 44-mm width of second framing panel 118. Thus, the distal lengthwise edge of each flat-spring panel 112 does not extend past the corresponding lengthwise edge of second framing panel 118. Furthermore, channel-dividing panel 114 has a width of 14.5 mm, such that the width of each channel 110 is also 14.5 mm. In this embodiment, the thickness of each of panels 116, 118, 120, 114 and flanges 112 is 1 mm.

Figure 3:
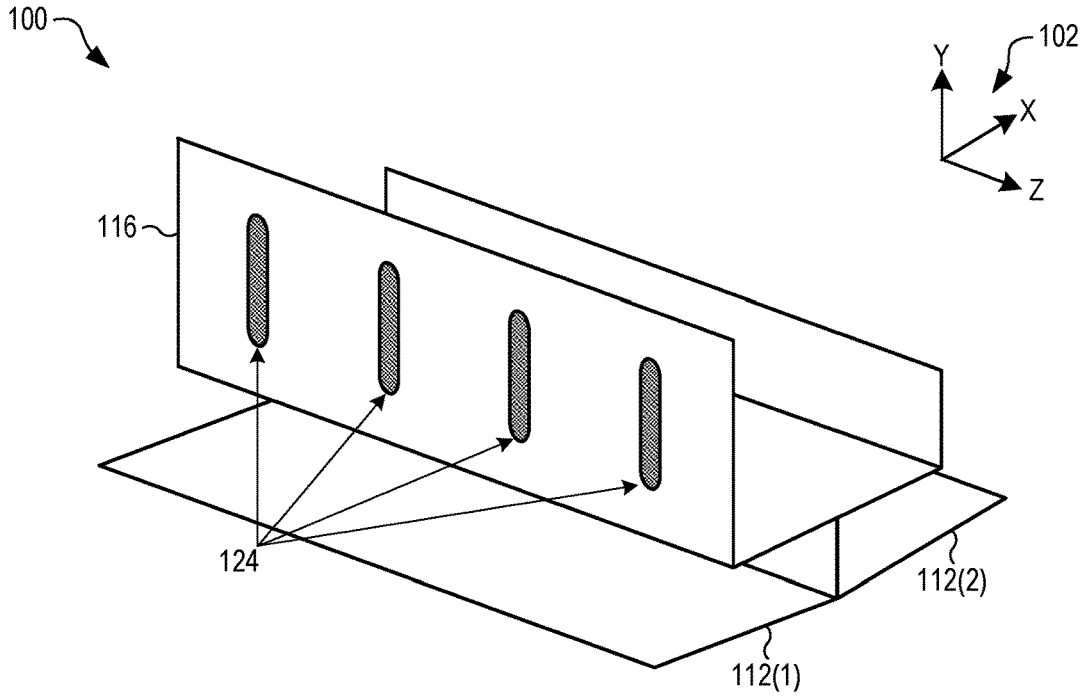
FIGS. 3 and 4 are two isometric views of the wallboard-fastening device of FIGS. 1 and 2, showing lengthwise extension in a z direction.
Figure 4:
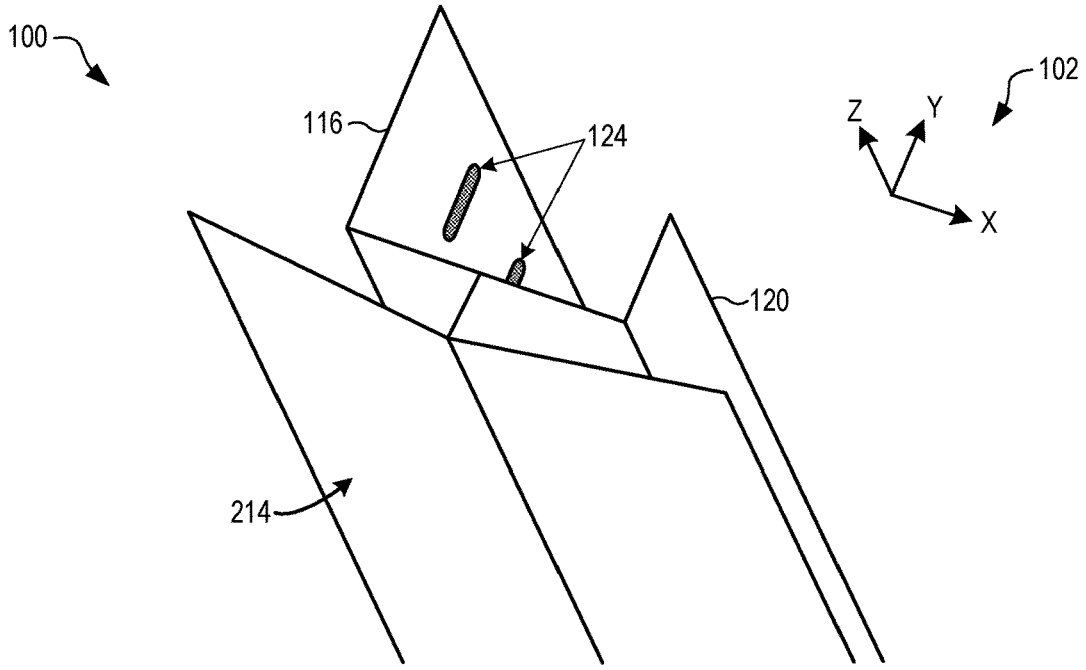

FIGS. 3 and 4 are two isometric views of wallboard-fastening device 100, showing lengthwise extension in the z direction. In FIGS. 3 and 4, first framing panel 116 forms a plurality of fastener holes 124 spaced lengthwise along first framing panel 116. In the z direction, a length of wallboard-fastening device 100 may be selected to match a corresponding length of wallboards 210. As shown in FIGS. 3 and 4, each flat-spring flange 112 may be a solid uniform planar panel free from holes. An outward-facing surface 214 of each flat-spring flange 112 (in the negative y direction) may be textured or processed to accept paint and/or a skim coat of joint compound.

Figure 5:
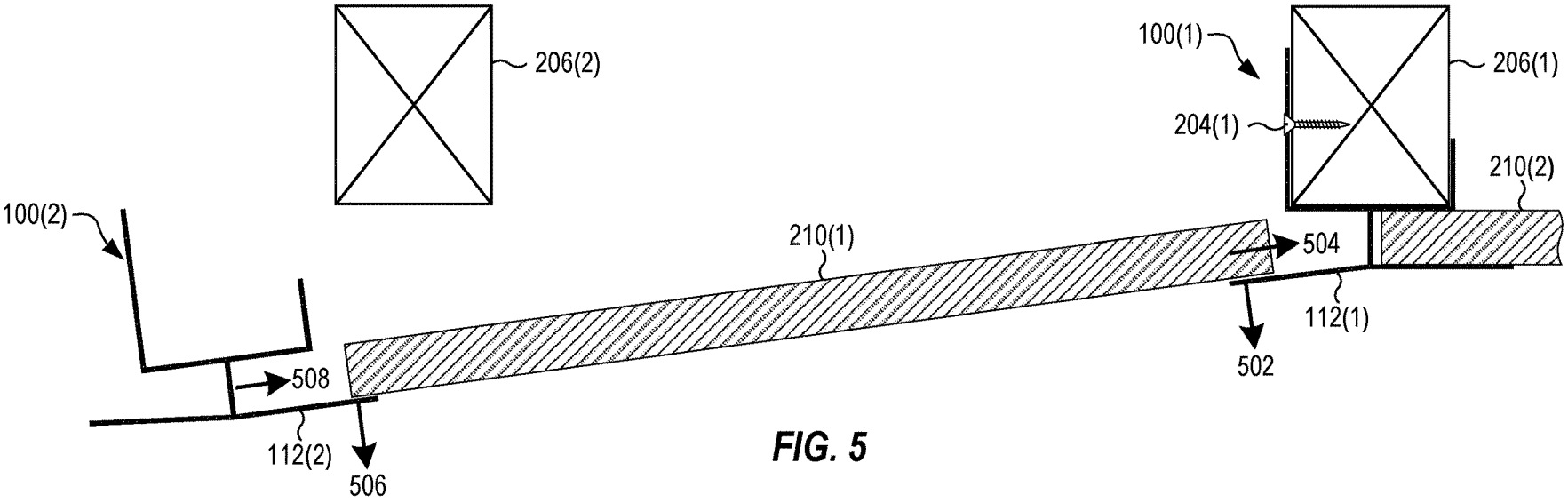
FIGS. 5-8 illustrate how a wallboard may be installed, with two of the wallboard-fastening devices of FIG. 1, to first and second wall studs, in an embodiment.

FIGS. 5-8 illustrate how wallboard 210(1) may be installed with first and second wallboard-fastening devices 100(1), 100(2) to first and second wall studs 206(1), 206(2). FIG. 5 shows wallboard 210(2) already fastened to first wall stud 206(1) with first wallboard-fastening device 100(1). In addition, FIG. 5 shows first wallboard-fastening device 100(1) affixed to first wall stud 206(1) with a first fastener 204(1).

In FIG. 5, a force 502 may be applied to flat-spring flange 112(1) to open the corresponding channel of first wallboard-fastening device 100(1) while wallboard 210(1) is pushed into the opened channel, as indicated by arrow 504. A force 506 may then be applied to flat-spring flange 112(2) of second wallboard-fastening device 100(2) to open the corresponding channel while second wallboard-fastening device 100(2) is pushed onto the opposite edge of wallboard 210(1), as indicated by arrow 508.

Figure 6:
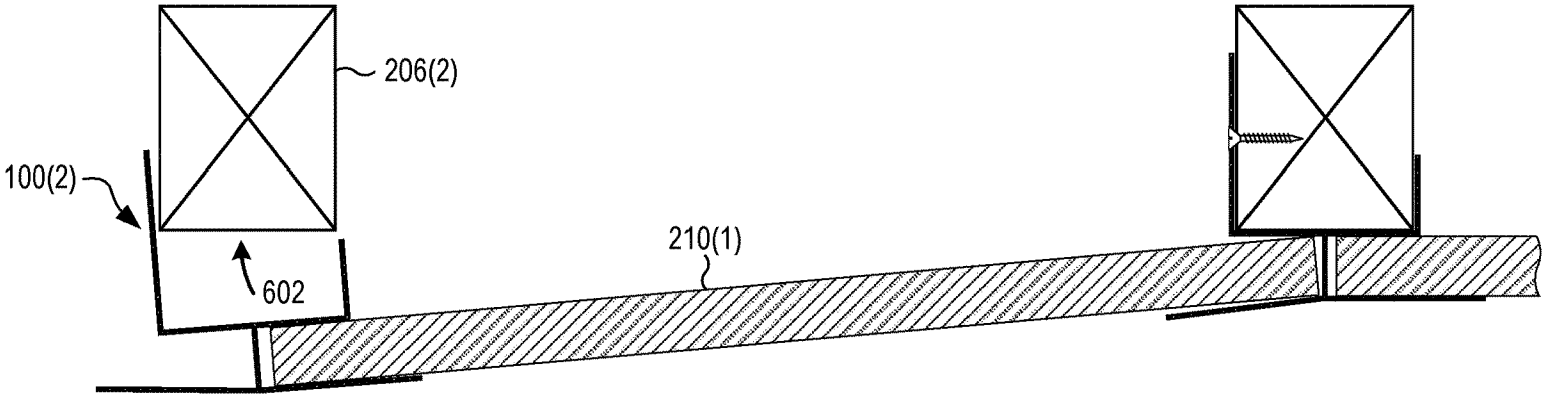

In FIG. 6, second wallboard-fastening device 100(2) may be pushed onto second wall stud 206(2), as indicated by arrow 602, so that the three-sided cup of second wallboard-fastening device 100(2) (see three-sided cup 104 in FIG. 1) fits around second wall stud 206(2).

Figure 7:
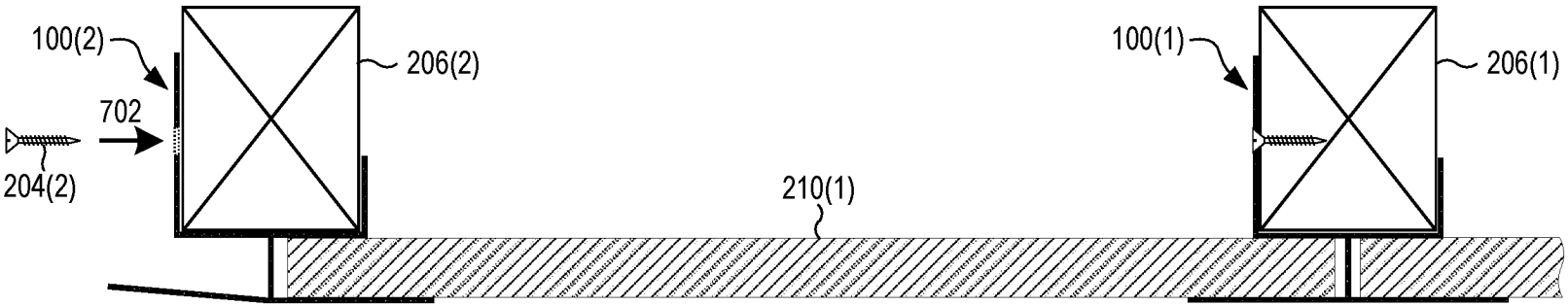

In FIG. 7, a second fastener 204(2) may be inserted through a fastener hole of second wallboard-fastening device 100(2) (see fastener hole 124 in FIG. 1) to secure second wallboard-fastening device 100(2) to second wall stud 206(2).

Figure 8:
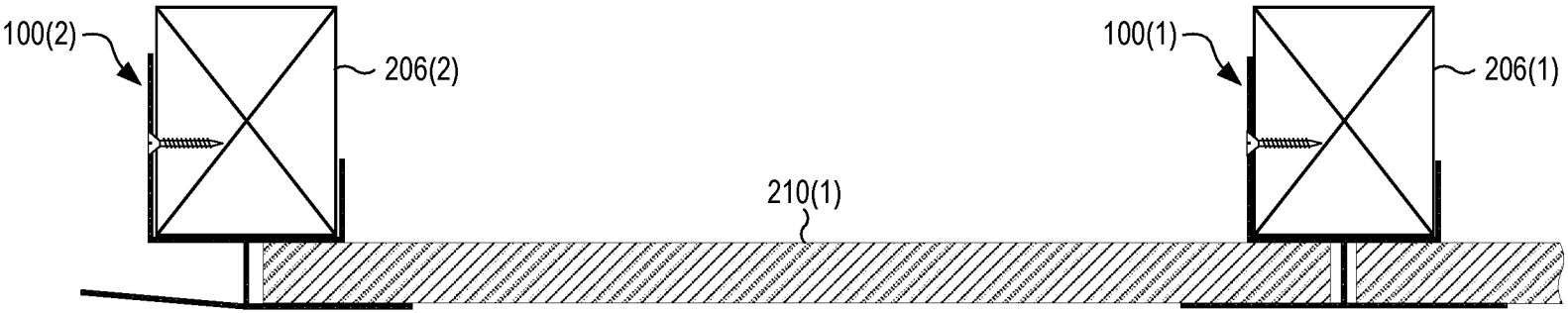

In FIG. 8, wallboard 210(1) is fully installed with first and second wallboard-fastening devices 100(1), 100(2) to first and second wall studs 206(1), 206(2). Furthermore, second wallboard-fastening device 100(2) is arranged identically to first wallboard-fastening device 100(1) in FIG. 5. The steps illustrated in FIGS. 5-7 may be repeated to install another wallboard to second wallboard-fastening device 100(2).

Although wallboard-fastening device 100 may secure wallboards 210 to stud 206 without fasteners 204 passing through wallboards 206, it may be beneficial to use additional fasteners 204 that secure wallboards 210 to stud 206 by passing through wallboards 210.

Figure 9:
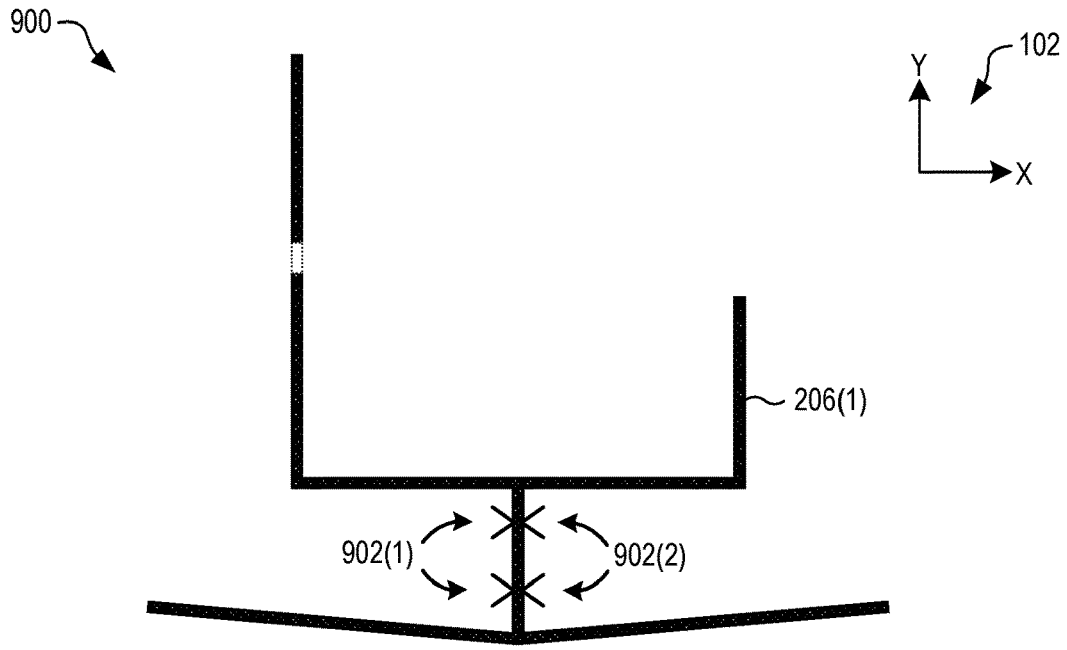
FIG. 9 is an end view of a wallboard-fastening device that is similar to the wallboard-fastening device of FIG. 1 except that it includes v-springs that implement a control joint, in an embodiment.
Figure 10:
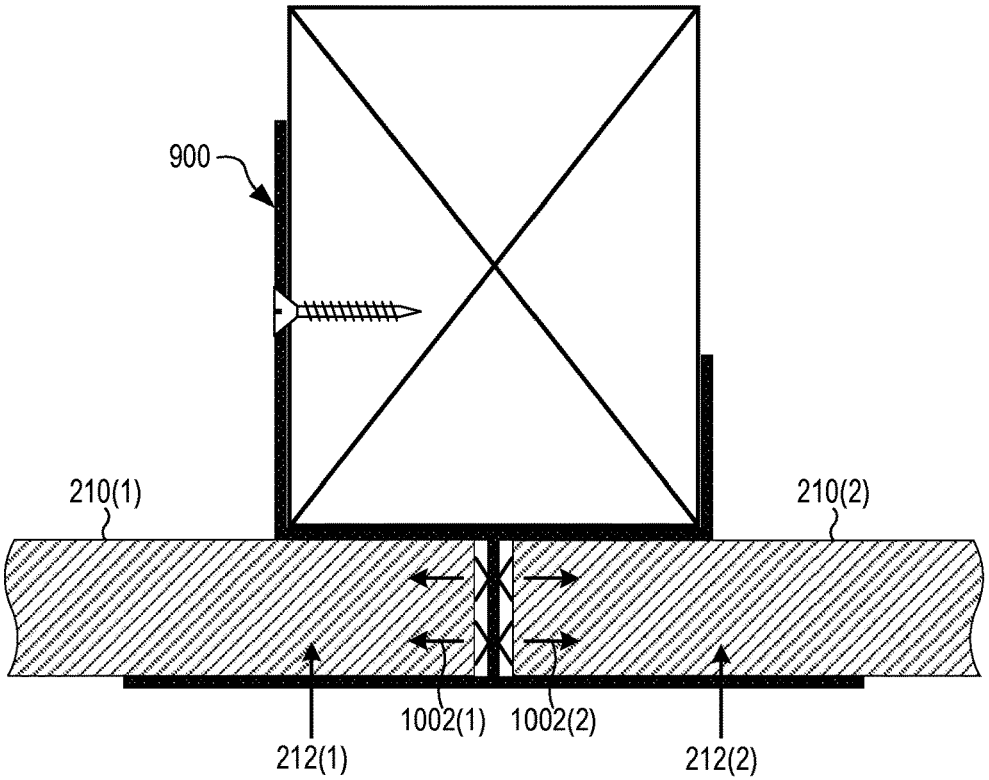
FIG. 10 illustrates the wallboard-fastening device of FIG. 9 securing first and second wallboards to a wall stud in an edge-joint configuration.

FIG. 9 is an end view of a wallboard-fastening device 900 that is similar to wallboard-fastening device 100 of FIG. 1 except that it includes v-springs 902 that implement a control joint. FIG. 10 illustrates wallboard-fastening device 900 of FIG. 9 securing first and second wallboards 210(1), 210(2) to a wall stud 206 in an edge-joint configuration. FIGS. 9 and 10 are best viewed together with the following description.

V-springs 902 are connected to channel-dividing panel 114 to flex when wallboards 210 are inserted into corresponding channels 110. Specifically, an end or edge of wallboard 210(1) facing channel 110(1) pushes against one or more v-springs 902(1), causing them to flex. In response, v-springs 902(1) exert a v-spring restoring force 1002(1) against the end of wallboard 210(1). As wallboard 210(1) expands, contracts, and/or shifts, the force exerted by wallboard 210(1) on v-springs 902(1) changes. In response to the changing wallboard force, v-springs 902(1) expand and/or contract accordingly so that v-spring restoring force 1002(1) remains equal and opposite to the wallboard force exerted thereon. Similar arguments hold for wallboard 210(2), one or more v-springs 902(2), and v-spring restoring force 1002(2).

Figure 11:
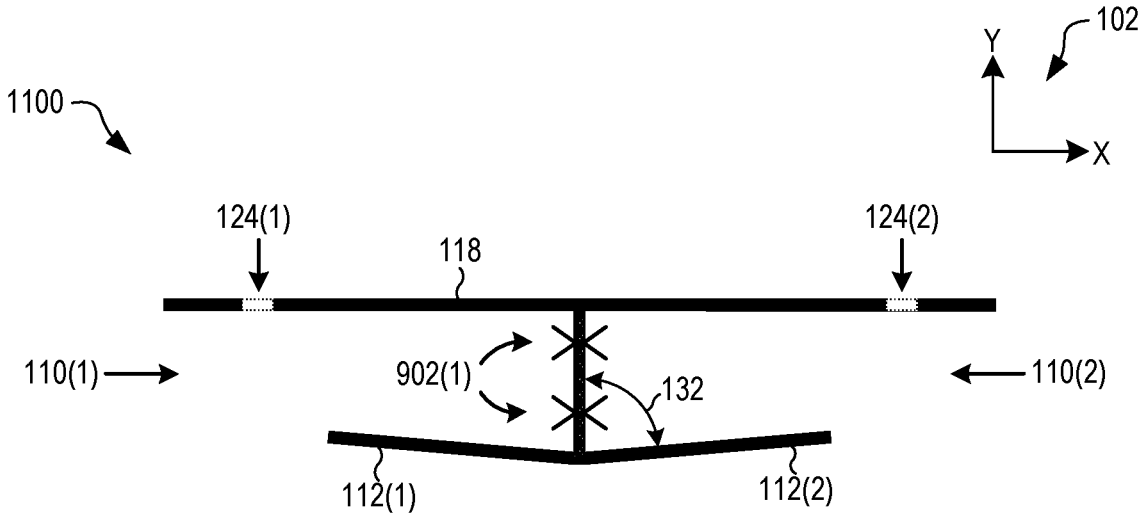
FIG. 11 is an end view of a wallboard-fastening device that implements an edge-joint with a double stud, in an embodiment.
Figure 12:
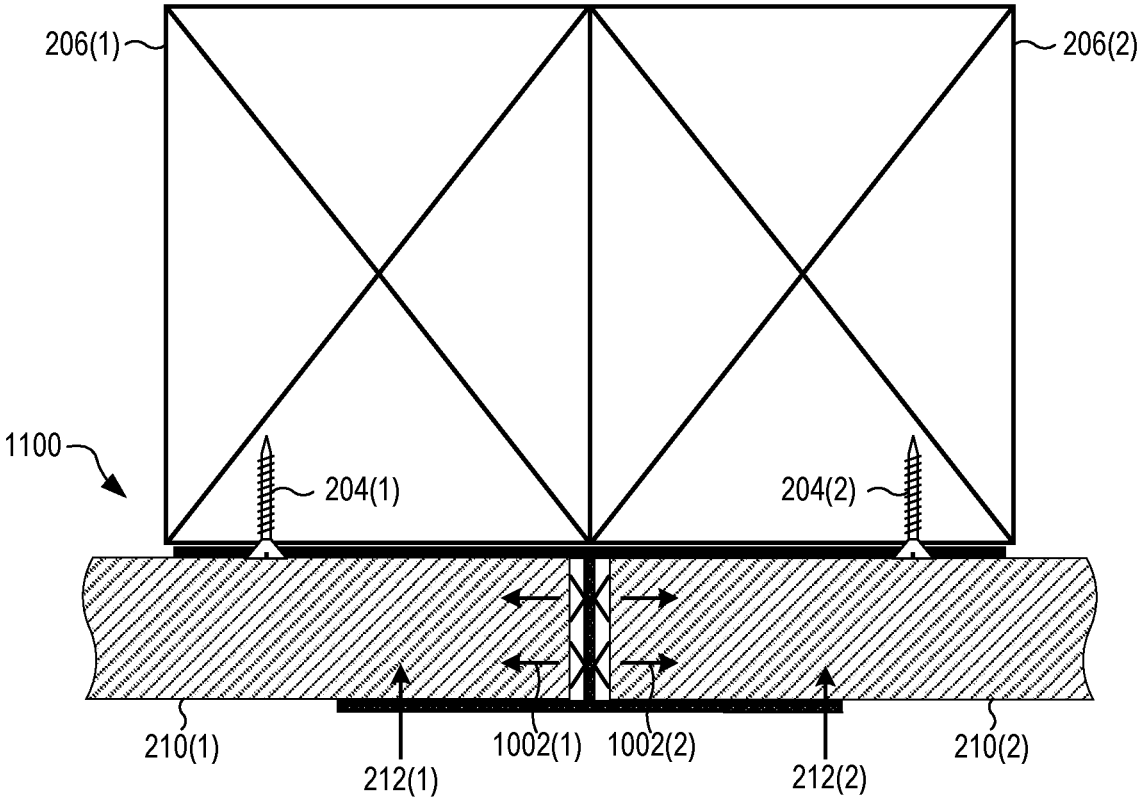
FIG. 12 illustrates the wallboard-fastening device of FIG. 11 physically securing wallboards to a double stud.

FIG. 11 is an end view of a wallboard-fastening device 1100 that implements an edge joint with a double stud. FIG. 12 illustrates wallboard-fastening device 1100 of FIG. 11 physically securing wallboards 210 to a double stud formed from a first stud 206(1) and a second stud 206(2). Wallboard-fastening device 1100 is similar to wallboard-fastening devices 100 of FIG. 1 except that it does not include first and third framing panels 116, 120, and thus does not form three-sided cup 104. Accordingly, a width of second framing 118 need not equal a combined width of studs 206(1) and 206(2). Wallboard-fastening device 1100 may be secured to first stud 206(1) with a first fastener 204(1) inserted through a first fastener hole 124(1). Wallboard-fastening device 1100 may be additionally or alternatively secured to second stud 206(2) with a second fastener 204(2) inserted through a second fastener hole 124(2). Wallboard-fastening device 1100 is shown in FIGS. 11 and 12 with v-springs 902, and thus implements a control joint similarly to wallboard-fastening device 900 of FIG. 9. However, wallboard-fastening device 1100 may be alternatively configured without v-springs 902. Furthermore, wallboard-fastening device 1100 may be alternatively configured with one or both of first and third framing panels 116, 120.

Wallboard-fastening device 1100 may advantageously be used for perpendicular applications where wallboard-fastening device 100 of FIGS. 1-2 cannot be used because first and third framing panels 116, 120 prevent second framing panel 118 from lying flush against wall studs 206. Without first and third framing panels 116, 120, wallboard-fastening device 1100 may be oriented such that second framing panel 118 lies flush against wall stud 206.

Embodiments for Outside-Corner Joints

Figure 13:
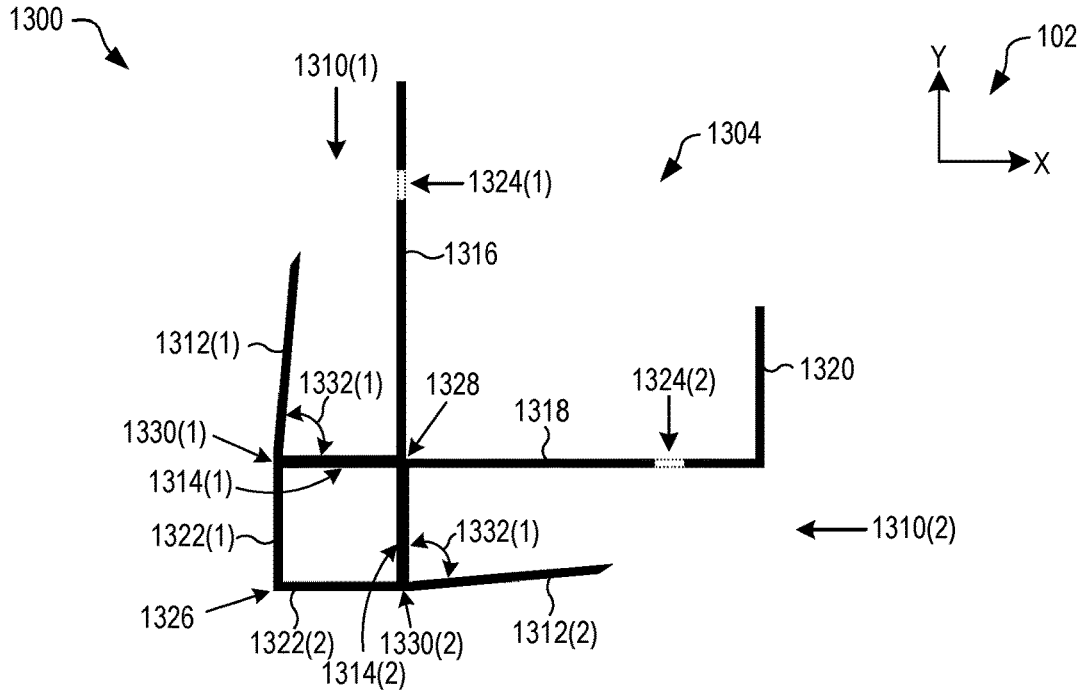
FIG. 13 is an end view of an outside-corner wallboard-fastening device that secures wallboards to a framing member in an outside-corner configuration without fasteners passing through the wallboards, in an embodiment.
Figure 14:
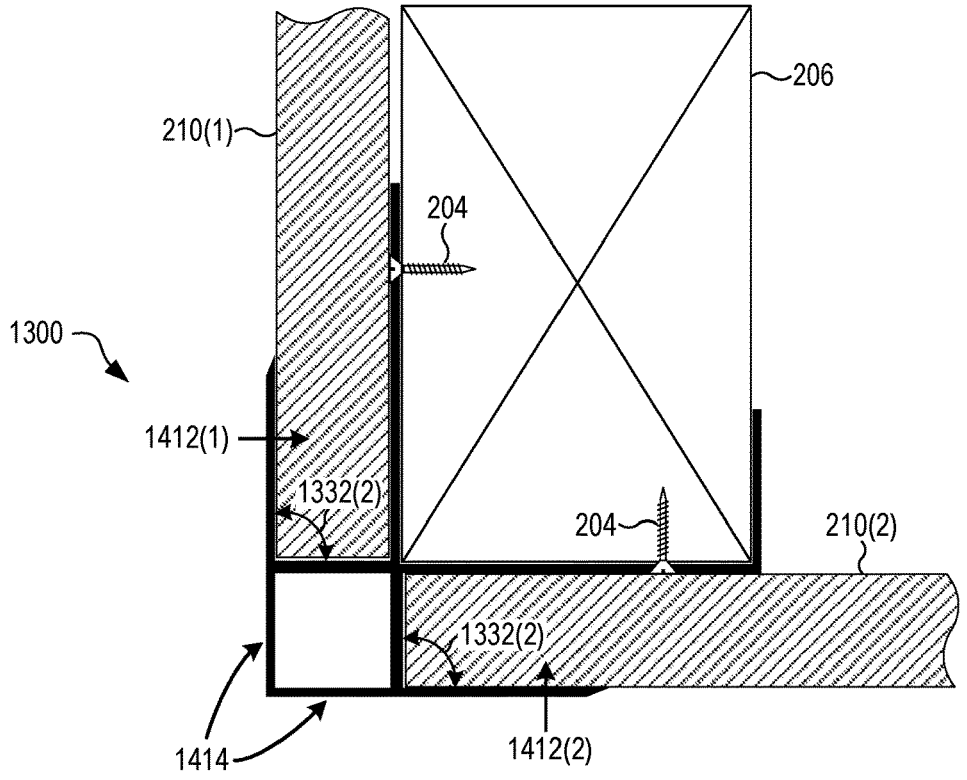
FIG. 14 illustrates the wallboard-fastening device of FIG. 13 securing first and second wallboards to a wall stud in the outside-corner configuration.

FIG. 13 is an end view of an outside-corner wallboard-fastening device 1300 that secures wallboards to a framing member in an outside-corner configuration without fasteners passing through the wallboards. FIG. 14 illustrates wallboard-fastening device 1300 of FIG. 13 securing first and second wallboards 210(1), 210(2) to a wall stud 206 in the outside-corner configuration. FIGS. 13 and 14 are best viewed together with the following description.

Wallboard-fastening device 1300 includes first, second, and third framing panels 1316, 1318, and 1320 joined along lengthwise edges (i.e., in the z direction; see right-handed coordinate system 102) to produce a three-sided cup 1304 that fits around wall stud 206. Three-sided cup 1304 is similar to three-sided cup 104 of FIG. 1. In FIG. 13, a first lengthwise edge of first framing panel 1316 is joined perpendicularly to a first lengthwise edge of second framing panel 1318 to form a framing seam 1328, and third framing panel 1320 is joined perpendicularly to a second lengthwise edge of second framing panel 1318. A width of first framing panel 1316 may be greater than a width of third framing panel 1320. Wallboard-fastening device 1300 may be configured without third framing panel 1320, wherein second framing panel 1318 may have a width that does match the width of wall stud 206.

Wallboard-fastening device 1300 forms first and second channels 1310(1), 1310(2) that receive first and second wallboard 210(1), 210(2), respectively, and thus are similar to first and second channels 110(1), 110(2) of FIGS. 1 and 2. First channel 1310(1) is formed from first framing panel 1316, a first flat-spring flange 1312(1), and a first bridge panel 1314(1). Second channel 1310(2) is formed from second framing panel 1318, a second flat-spring flange 1312(2), and a second bridge panel 1314(2). When wallboards 210 are absent from channels 1310, each flat-spring flange 1312 forms a nominal angle 1332(1) with its respective bridge panel 1314 that is less than ninety degrees (e.g., eighty-five degrees).

Wallboard-fastening device 1300 also includes first and second corner panels 1322(1) and 1322(2) that are joined along lengthwise edges to form a two-hundred-seventy-degree angle facing away from three-sided cup 1304, and a complementary right angle facing toward three-sided cup 1304. That is, a first lengthwise edge of first corner panel 1322(1) is joined perpendicularly to a first lengthwise edge of the second corner panel 1322(2) to form an outward corner 1326. Furthermore, a first lengthwise edge of first bridge panel 1314(1) is joined perpendicularly to a second lengthwise edge of first corner panel 1322(1) to form a first outer seam 1330(1), and a first lengthwise edge of second bridge panel 1314(2) is joined perpendicularly to a second lengthwise edge of second corner panel 1322(2) to form a second outer seam 1330(2). In addition, a second lengthwise edge of first bridge panel 1314(1) is joined perpendicularly with a second lengthwise edge of second bridge panel 1314(2) to form a rear-corner seam that directly coincides with framing seam 1328 of three-sided cup 1304. Thus, bridge panels 1314(1), 1314(2) and front panels 1322(1), 1322(2) cooperate to form a square tube. As shown in FIGS. 13 and 14, bridge panels 1314 may be thicker than front panels 1322 to increase rigidity.

First flat-spring flange 1312(1) is joined along a lengthwise edge to first outer seam 1330(1) such that first flat-spring flange 1312(1), first bridge panel 1314(1), and first framing panel 1316 form first channel 1310(1). Similarly, second flat-spring flange 1312(2) is joined along a lengthwise edge to second outer seam 1330(2) such that second flat-spring flange 1312(2), second bridge panel 1314(2), and second framing panel 1318 form second channel 1310(2). First flat-spring flange 1312(1) may have a width less than that of first framing panel 1316, and second flat-spring flange 1312(2) may have a width less than that of second framing panel 1318.

When wallboards 210 are inserted into channels 1310, each flat-spring flange 1312 comes to rest forming, with its corresponding bridge panel 1314, a rest angle 1332(2) of ninety degrees that is greater than nominal angle 1332(1). Furthermore, first flat-spring flange 1312(1) comes to rest parallel to first framing panel 1316, and second flat-spring flange 1312(2) comes to rest parallel to second framing panel 1318. Accordingly, wallboards 210 are perpendicular to each other. First flat-spring flange 1312(1) exerts a first restoring force 1412(1) on first wallboard 210(1) to push first wallboard 210(1) against first framing panel 1316. Similarly, second flat-spring flange 1312(2) exerts a second restoring force 1412(2) on second wallboard 210(2) to push second wallboard 210(2) against second framing panel 1318.

Although not shown in FIGS. 13 and 14, each of first framing panel 1316, second framing panel 1318, third framing panel 1320, corner panels 1322, bridge panels 1314, and flat-spring flanges 1412 has a thickness. In one embodiment, each of first framing panel 1316, second framing panel 1318, third framing panel 1320, corner panels 1322, bridge panels 1314, and flat-spring flanges 1312 has a similar thickness (e.g., 1 mm). However, first framing panel 1316, second framing panel 1318, third framing panel 1320, corner panels 1322, bridge panels 1314, ant flat-spring flanges 1312 may alternatively have different thicknesses.

In one embodiment, nominal angle 1332(1) is eighty-five degrees, first framing panel 1316 has a width of 30 mm, second framing panel 1318 has a width of 44 mm, third framing panel 1320 has a width of 10 mm, and each of first and second flat-spring flanges 1312 has a width of 20 mm. Furthermore, each of corner panels 1322 and bridge panels 1314 has a width of 16 mm such that the width of each channel 1310 is also 16 mm. In this embodiment, the thickness of each of panels 1316, 1318, 1320, 1314, 1322 and flanges 1312 is 1 mm.

Figure 15:
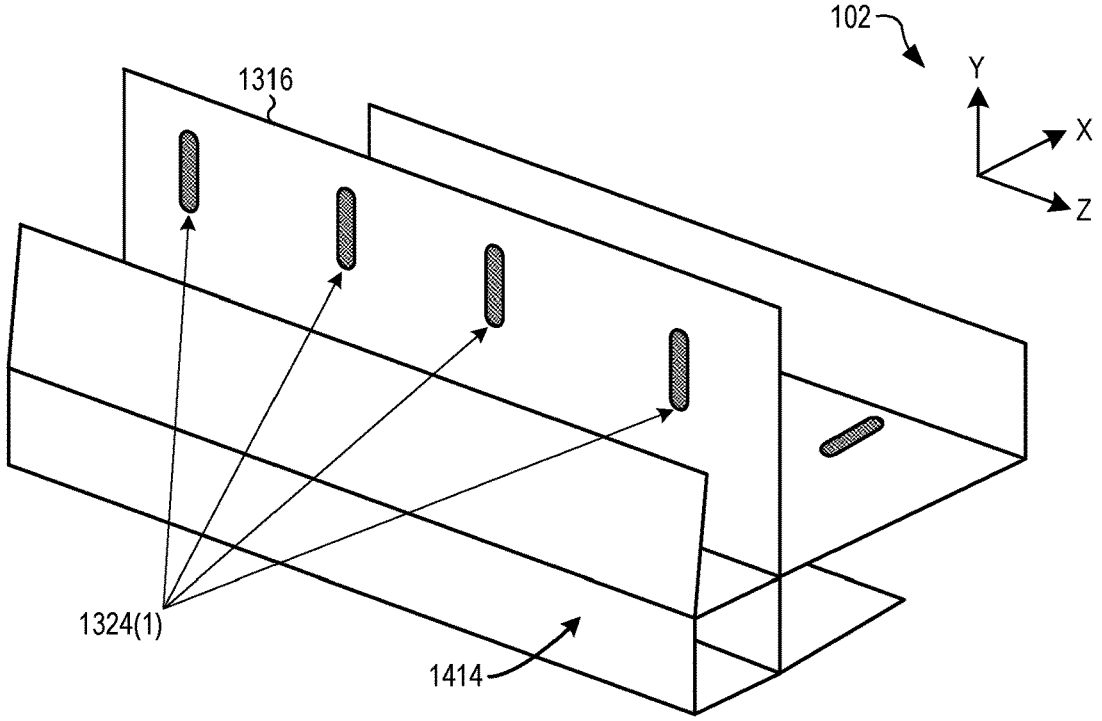
FIGS. 15 and 16 are two isometric views of the wallboard-fastening device of FIGS. 13 and 14, showing lengthwise extension in the z direction.
Figure 16:
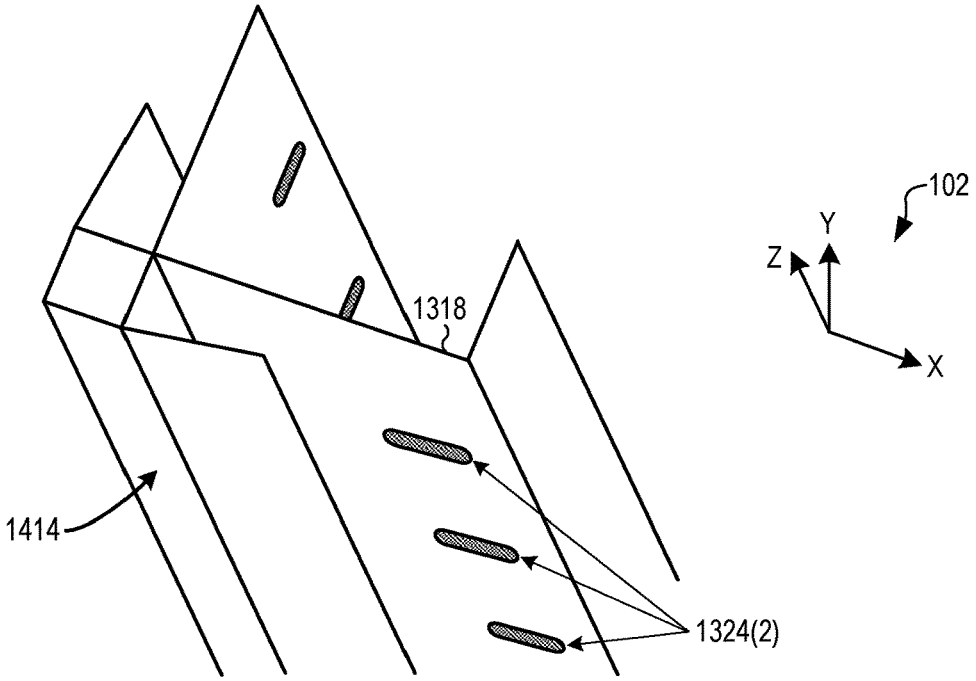

FIGS. 15 and 16 are two isometric views of wallboard-fastening device 1300, showing lengthwise extension in the z direction. In FIG. 15, first framing panel 1316 forms one or more fastener holes 1324 spaced lengthwise along first framing panel 1316. In FIG. 16, second framing panel 1318 forms one or more fastener holes 1324 spaced lengthwise along second framing panel 1318. A length of wallboard-fastening device 1300, in the z direction, may be selected to match a corresponding length of wallboards 210. As shown in FIGS. 15 and 16, each flat-spring flange 1312 may be a solid uniform planar panel free from holes. Outward-facing surfaces 1414 of each flat-spring flange 1312 may be textured or processed to accept paint and/or a skim coat of plaster. Similar to wallboard-fastening devices 100, 900, and 1100, wallboard-fastening device 1300 may be made of PVC, vinyl or another material that can be extruded.

Figure 17:
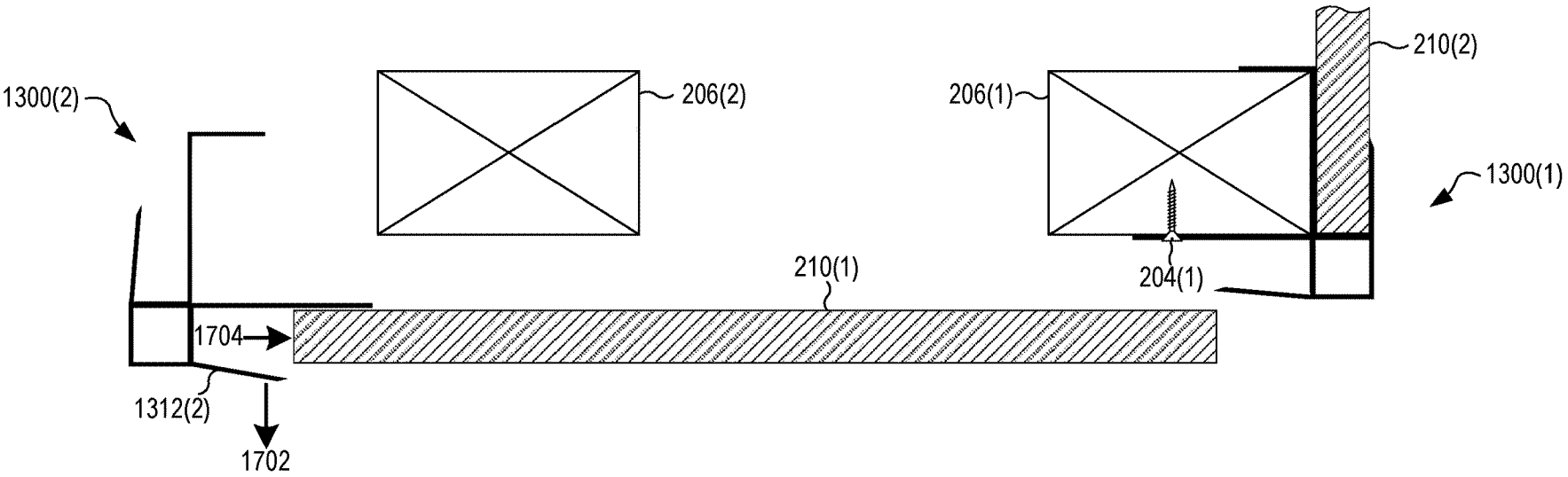
FIGS. 17-20 illustrate how a wallboard may be installed with two of the wallboard-fastening devices of FIG. 13 to first and second wall studs, in an embodiment.

FIGS. 17-20 illustrate how wallboard 210(1) may be installed with first and second wallboard-fastening devices 1300(1), 1300(2) to first and second wall studs 206(1), 206(2). FIG. 17 shows wallboard 210(2) already fastened to first wall stud 206(1) with first wallboard-fastening device 1300(1). In addition, FIG. 17 shows first wallboard-fastening device 1300(1) affixed to first wall stud 206(1) with a first fastener 204(1).

In FIG. 17, a force 1702 may be applied to flat-spring flanges 1312(2) to open the corresponding channel of second wallboard-fastening device 1300(2) while pushing second wallboard-fastening device 1300(2) onto wallboard 210(1), as indicated by arrow 1704.

Figure 18:
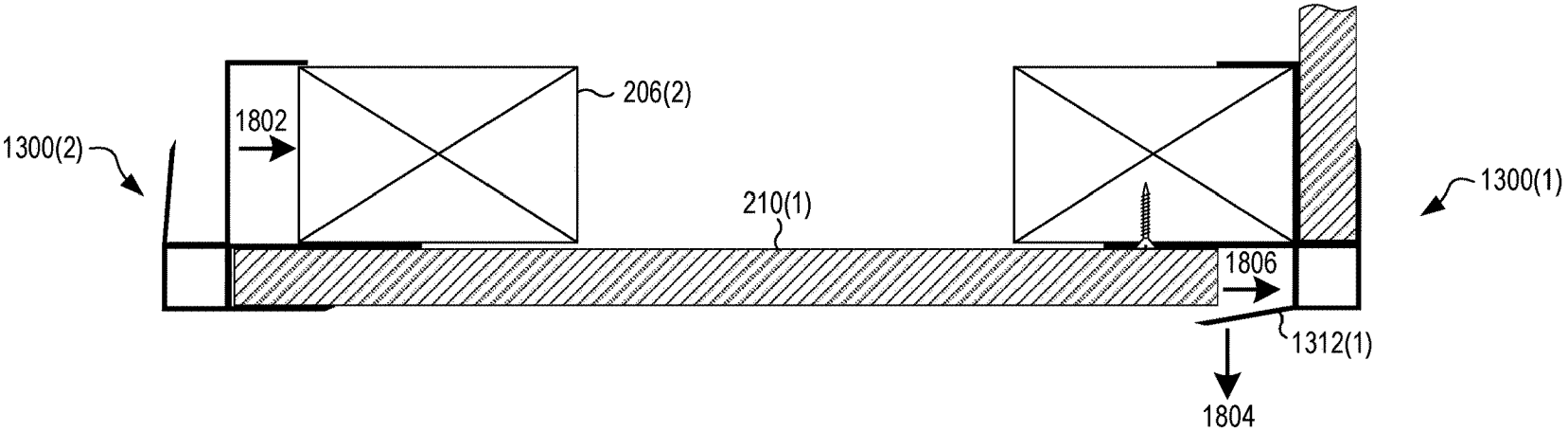

In FIG. 18, a force 1804 may be applied to flat-spring flange 1312(1) of first wallboard-fastening device 1300(1) to open the corresponding channel of first wallboard-fastening device 1300(1) while pushing wallboard 210(2) into the opened channel, as indicated by arrow 1806. Simultaneously, second wallboard-fastening device 1300(2) is aligned with second wall stud 206(2) such that three-sided cup 1304 of second wallboard-fastening device 1300(2) fits around second wall stud 206(2), as indicated by arrow 1802.

Figure 19:
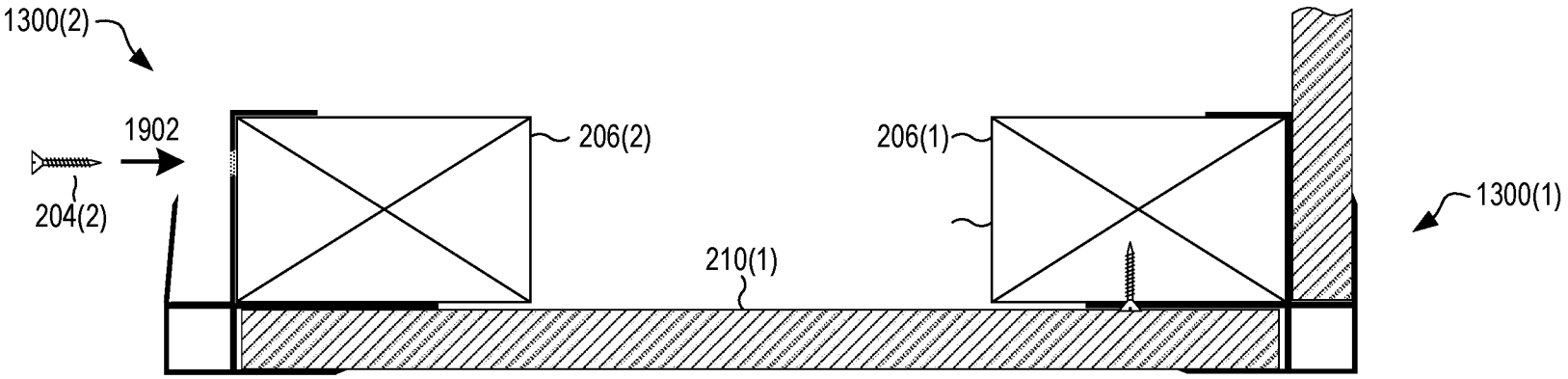

In FIG. 19, a second fastener 204(2) may be inserted through a fastener hole of second wallboard-fastening device 1300(2) (see fastener hole 1324(2) in FIG. 13) to secure second wallboard-fastening device 1300(2) to second wall stud 206(2).

Figure 20:
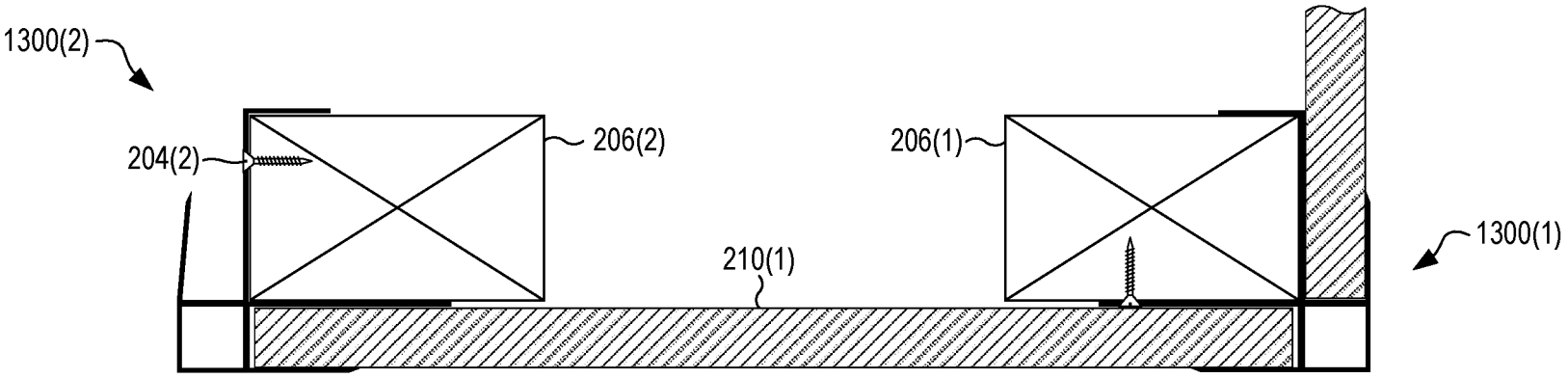

In FIG. 20, wallboard 210(1) is fully installed with first and second wallboard-fastening devices 1300(1), 1300(2) to first and second wall studs 206(1), 206(2). Furthermore, second wallboard-fastening device 1300(2) is arranged identically to first wallboard-fastening device 1300(1) in FIG. 17. The steps illustrated in FIGS. 17-20 may be repeated to install another wallboard to second wallboard-fastening device 1300(2).

Figure 21:
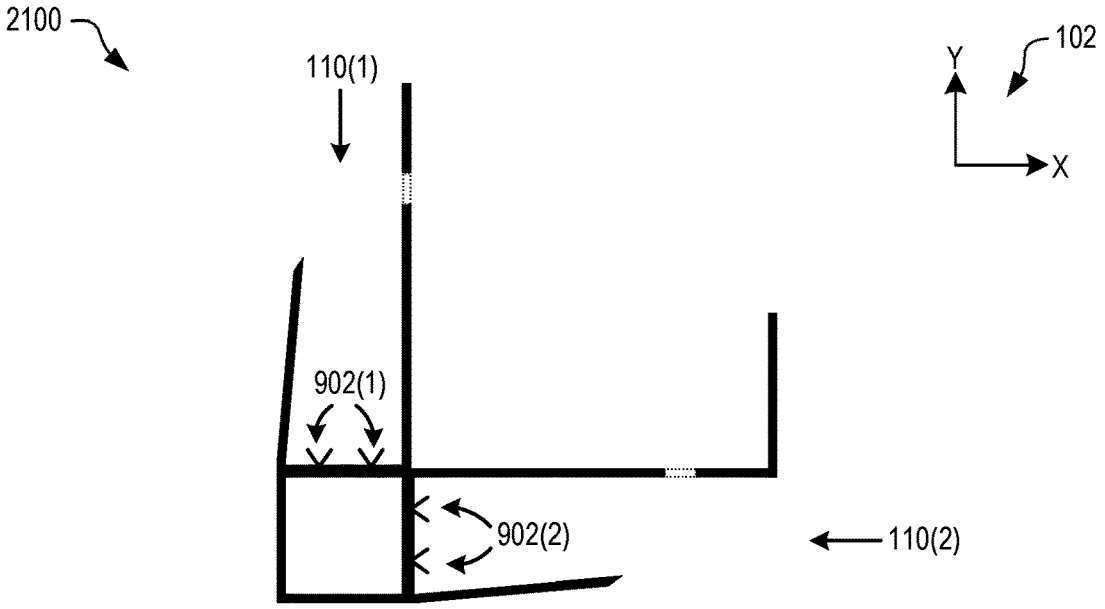
FIG. 21 is an end view of a wallboard-fastening device that is similar to the wallboard-fastening device of FIGS. 13 and 14 except that it includes v-springs that implement a control joint, in an embodiment.
Figure 22:
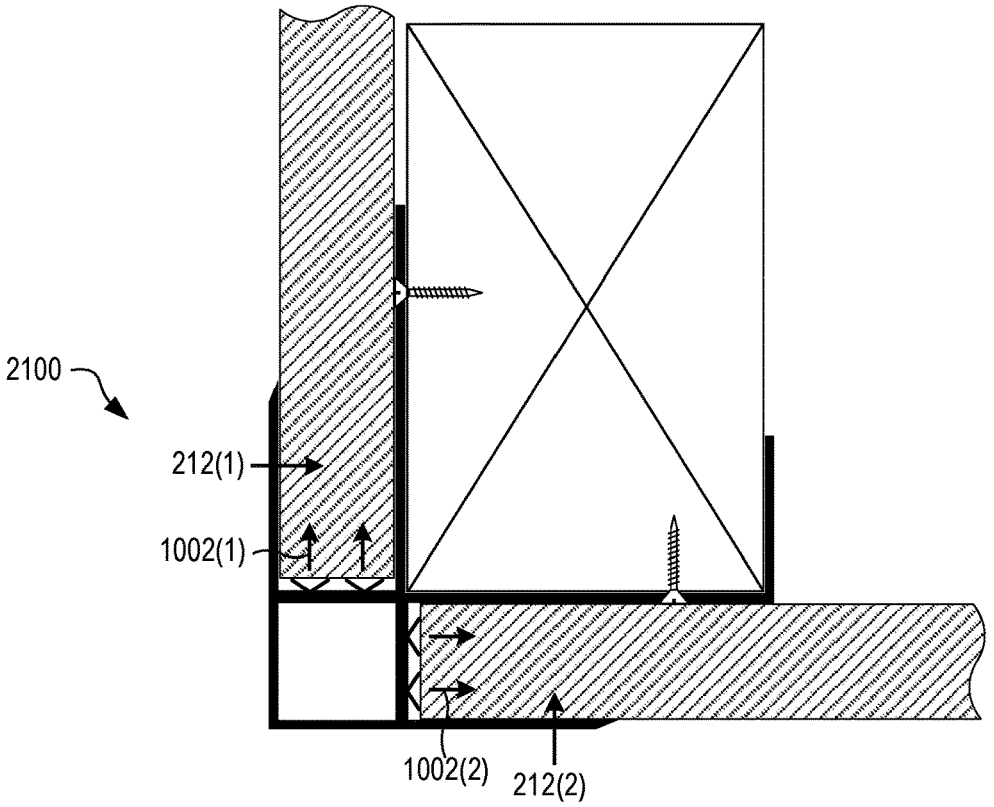
FIG. 22 illustrates the wallboard-fastening device of FIG. 21 securing first and second wallboards to a wall stud in an outside-corner configuration.

FIG. 21 is an end view of a wallboard-fastening device 2100 that is similar to wallboard-fastening device 1300 of FIGS. 13 and 14 except that it includes v-springs 902 that implement a control joint. FIG. 22 illustrates wallboard-fastening device 2100 of FIG. 21 securing first and second wallboards 210(1), 210(2) to a wall stud 206 in an outside-corner configuration. As shown in FIGS. 21 and 22, wallboard-fastening device 2100 implements a control joint similar to wall-fastening device 900, as described above for FIGS. 9 and 10.

Embodiments for Inside-Corner Joints

Figure 23:
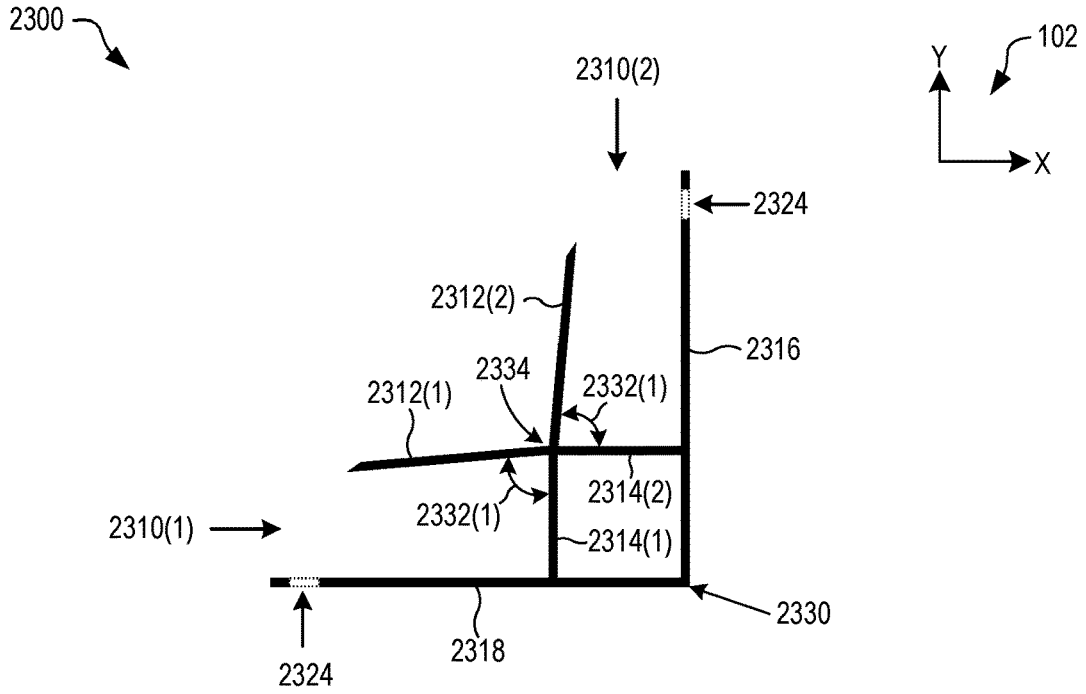
FIG. 23 is an end view of an inside-corner wallboard-fastening device that secures wallboards to a framing member in an inside-corner configuration without fasteners passing through the wallboards, in an embodiment.
Figure 24:
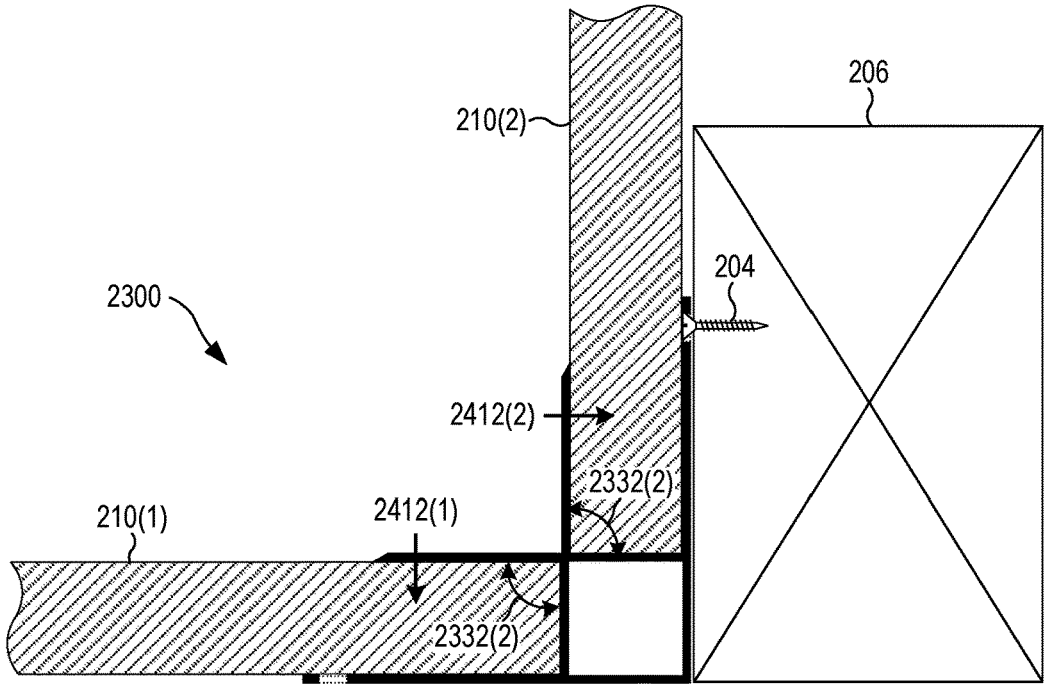
FIG. 24 illustrates the wallboard-fastening device of FIG. 23 securing first and second wallboards to a wall stud in the inside-corner configuration.

FIG. 23 is an end view of an inside-corner wallboard-fastening device 2300 that secures wallboards to a framing member in an inside-corner configuration without fasteners passing through the wallboards. FIG. 24 illustrates wallboard-fastening device 2300 of FIG. 23 securing first and second wallboards 210(1), 210(2) to a wall stud 206 in the inside-corner configuration. FIGS. 23 and 24 are best viewed together with the following description.

Wallboard-fastening device 2300 includes first and second framing panels 2316 and 2318 joined perpendicularly along lengthwise edges (i.e., in the z direction; see right-handed coordinate system 102) to form a rear seam 2330. Wallboard-fastening device 2300 forms first and second channels 2310(1), 2310(2) that receive first and second wallboard 210(1), 210(2), respectively, and thus are similar to first and second channels 110(1), 110(2) of FIGS. 1 and 2. First channel 2310(1) is formed from first framing panel 2316, a first flat-spring flange 2312(1), and a first bridge panel 2314(1). Second channel 2310(2) is formed from second framing panel 2318, a second flat-spring flange 2312(2), and a second bridge panel 2314(2). When wallboards 210 are absent from channels 2310, each of flat-spring flanges 2312 forms a nominal angle 2332(1) with its respective bridge panel 2314 that is less than ninety degrees (e.g., eighty-five degrees).

A first lengthwise edge of first bridge panel 2314(1) is joined perpendicularly to a first lengthwise edge of second bridge panel 2314(2) to form a corner seam 2334. A second lengthwise edge of first bridge panel 2314(1) is joined perpendicularly to first framing panel 2316 away from rear seam 2330, and a second lengthwise edge of second bridge panel 2314(2) is joined perpendicularly to second framing panel 2318 away from rear seam 2330. Thus, bridge panels 2314(1), 2314(2) cooperate with first and second framing panels 2316, 218 to form a square tube.

A lengthwise edge of first flat-spring flange 2312(1) is joined to corner seam 2334 such that first flat-spring flange 2312(1), first bridge panel 2314(1), and first framing panel 2316 form first channel 2310(1). Similarly, a lengthwise edge of second flat-spring flange 2312(2) is joined to corner seam 2334 such that second flat-spring flange 2312(2), second bridge panel 2314(2), and second framing panel 2318 form second channel 2310(2). First flat-spring flange 2312(1) may have a width less than that of first framing panel 2316, and second flat-spring flange 2312(2) may have a width less than that of second framing panel 2318.

When wallboards 210 are inserted into channels 2310, each flat-spring flange 2312 comes to rest forming, with its corresponding bridge panel 2314, a rest angle 2332(2) of ninety degrees that is greater than nominal angle 2332(1). Furthermore, first flat-spring flange 2312(1) comes to rest parallel to first framing panel 2316, and second flat-spring flange 2312(2) comes to rest parallel to second framing panel 2318. Accordingly, wallboards 210 are perpendicular to each other. First flat-spring flange 2312(1) exerts a first restoring force 2412(1) on first wallboard 210(1) to push first wallboard 210(1) against first framing panel 2316. Similarly, second flat-spring flange 2312(2) exerts a second restoring force 2412(2) on second wallboard 210(2) to push second wallboard 210(2) against second framing panel 2318.

Although not shown in FIGS. 23 and 24, each of first framing panel 2316, second framing panel 2318, bridge panels 2314, and flat-spring flanges 2312 has a thickness. In one embodiment, each of first framing panel 2316, second framing panel 2318, bridge panels 2314, and flat-spring flanges 2312 has a similar thickness (e.g., 1 mm). However, first framing panel 2316, second framing panel 2318, bridge panels 2314, and flat-spring flanges 2312 may alternatively have different thicknesses.

In one embodiment, nominal angle 2332(1) is eighty-five degrees, each of first framing panel 2316 and second framing panel 2318 has a width of 45 mm, and each of first and second flat-spring flanges 2312 has a width of 18 mm. Furthermore, each of bridge panels 2314 has a width of 16 mm such that the width of each channel 2310 is also 16 mm. In this embodiment, the thickness of each of panels 2316, 2318, 2314 and flanges 2312 is 1 mm.

First framing panel 2316 may form one or more fastener holes 2324 spaced lengthwise along first framing panel 2316. Alternatively or additionally, second framing panel 2318 may form one or more fastener holes 2324 spaced lengthwise along second framing panel 2318. Although not shown in FIGS. 23 and 24, a length of wallboard-fastening device 2300, in the z direction, may be selected to match a corresponding length of wallboards 210. Each flat-spring flange 2312 may be a solid uniform planar panel free from holes. Outward-facing surfaces of each flat-spring flange 2312 may be textured or processed to accept paint and/or a skim coat of plaster. Similar to wallboard-fastening devices 100, 900, 1100, 1300, and 2100, wallboard-fastening device 2300 may be made of PVC, vinyl or another material that can be extruded.

A plurality of wallboard-fastening devices 2300 may be used to install multiple wallboards 210 to several studs 206 in a manner similar to that shown in FIGS. 4-8 for creating an edge-joint with wallboard-fastening devices 100, and shown in FIGS. 15-18 for creating an outside-corner joint with wallboard-fastening devices 1300. Wallboard-fastening device 2300 may also be configured with v-springs 902, similar to wallboard fastening devices 1100 (see FIG. 11) and 2100 (see FIG. 21) to implement a control joint.

Additional Embodiments for Corner Joints

Figure 25:
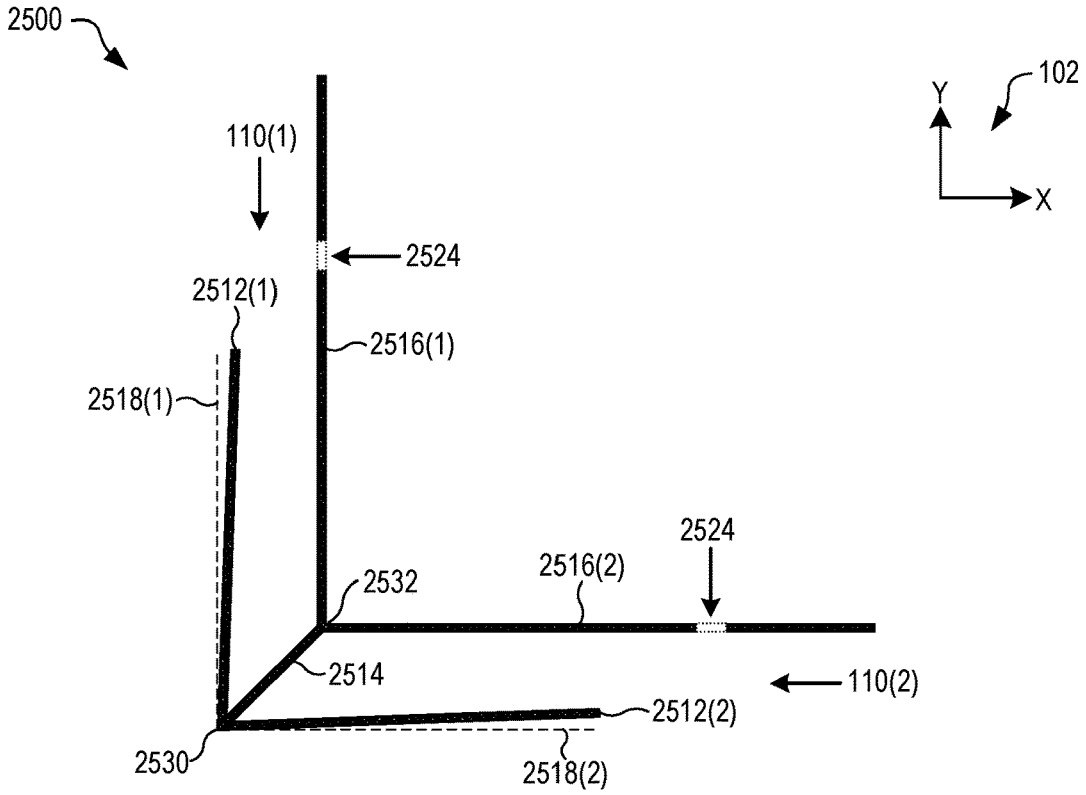
FIG. 25 shows an outside-corner wallboard-fastening device that is similar to the wallboard-fastening device of FIG. 23, except forms first and second channels with a single planar channel-dividing panel that directly connects to a front seam and directly connects to a rear seam, in an embodiment.

FIG. 25 shows an outside-corner wallboard-fastening device 2500 that is similar to wallboard-fastening device 2300 of FIG. 23, except forms first and second channels 110(1), 110(2) with a single planar channel-dividing panel 2514 that directly connects to a front seam 2530 and directly connects to a rear seam 2532. Wallboard-fastening device 2500 includes first and second framing panels 2516(1), 2516(2) joined along lengthwise edges to form a right angle that fits around a corner of a wall stud (e.g., wall stud 206), similar to first and second framing panels 2316 and 2318 of FIG. 23. Wallboard-fastening device 2500 also includes first and second flat-spring flanges 2512(1), 2512(2) that are similar to flat-spring flanges 2312 of FIG. 23. Specifically, first and second flat-spring flanges 2512(1), 2512(2) are not parallel to respective first and second framing panels 2516(1), 2516(2). When a first wallboard is inserted into first channel 110(1), first flat-spring flange 2512(1) is flexed, coming to rest at a first flexed position 2518(1) parallel to first framing panel 2516(1). Similarly, when a second wallboard is inserted into second channel 110(2), second flat-spring flange 2512(1) is flexed, coming to rest at a second flexed position 2518(2) parallel to second framing panel 2516(2). Thus, first and second flat-spring flanges 2512(1), 2512(2), when flexed, exert spring restoring forces (e.g., restoring forces 212) on the wallboards, thereby physically securing them.

One or both of first and second framing panels 2516(1), 2516(2) may form a plurality of fastener holes 2524 spaced lengthwise (i.e., in the z direction). In the x-y plane, each fastener hole 2524 is located sufficiently far from rear seam 2532 that a fastener may be inserted therethrough without physical blockage from the corresponding flat-spring flange 2512. Thus, each fastener hole 2524 on first framing panel 2516(1) has a y-coordinate (see coordinate system 102) greater than the y coordinate of the outer lengthwise edge of first flat-spring flange 2512(1). Similarly, each fastener hole 2524 on second framing panel 2516(2) has an x coordinate greater than the x coordinate of the outer lengthwise edge of second flat-spring flange 2512(2). The outer lengthwise edges of flat-spring flanges 2512 are those lengthwise edges located away from front seam 2530 (i.e., opposite inner lengthwise edges of flat-spring flanges 2512 that are joined to form front seam 2530).

Figure 26:
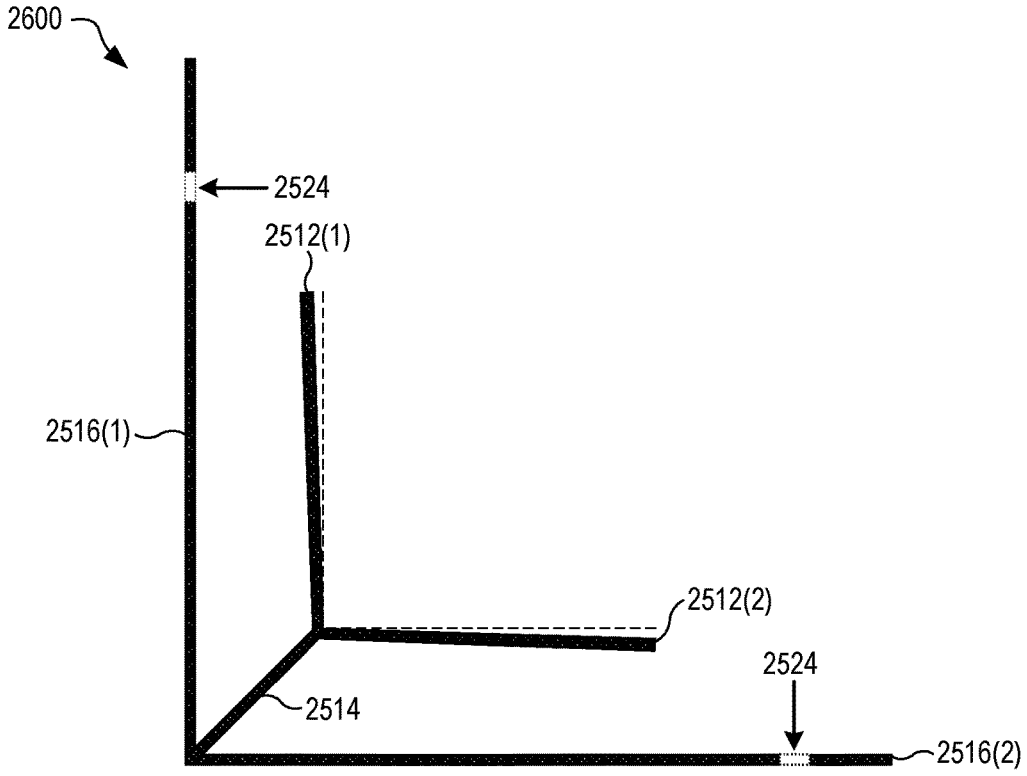
FIG. 26 shows an inside-corner wallboard-fastening device that is similar to the outside-corner wallboard-fastening device of FIG. 25, except configured to secure two wallboards in an inside-corner configuration, in an embodiment.

FIG. 26 shows an inside-corner wallboard-fastening device 2600 that is similar to outside-corner wallboard-fastening device 2500 of FIG. 25, except configured to secure two wallboards in an inside-corner configuration.

Figure 27:
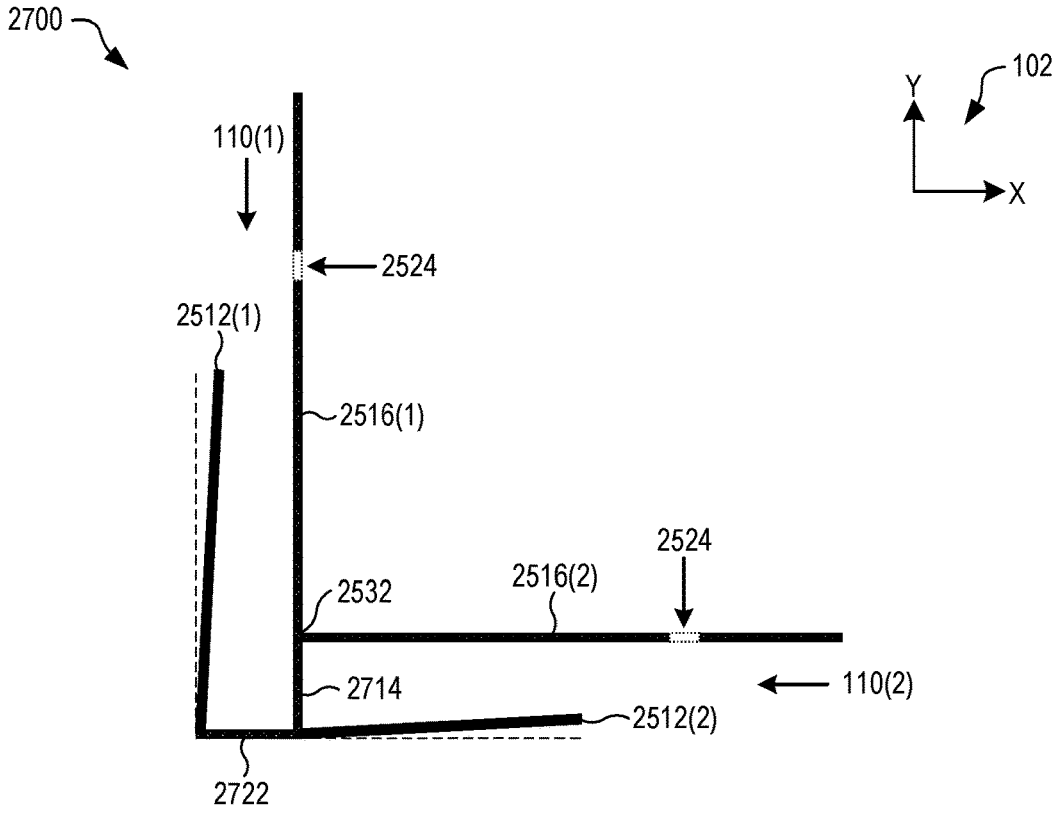
FIG. 27 shows an outside-corner wallboard-fastening device that forms first and second channels with a single planar channel-dividing panel that is coplanar with a first framing panel, in an embodiment.

FIG. 27 shows an outside-corner wallboard-fastening device 2700 that forms first and second channels 110(1), 110(2) with a single planar channel-dividing panel 2714 that is coplanar with first framing panel 2516(1). Wallboard-fastening device 2700 is similar to wallboard-fastening device 2500 of FIG. 25 except that a wallboard may be inserted into first channel 110(1) all the way to a corner panel 2722, thereby reinforcing the outside corner. One lengthwise edge of channel-dividing panel 2714 directly connects to rear seam 2532, and the other lengthwise edge of channel-dividing panel 2714 directly connects to a seam formed where lengthwise edges of corner panel 2722 and second flat-spring flange 2512(2) are joined. While FIG. 27 shows channel-dividing panel 2714 as coplanar with first framing panel 2516(1), channel-dividing panel 2714 may alternatively be coplanar with second framing panel 2516(2).

Figure 28:
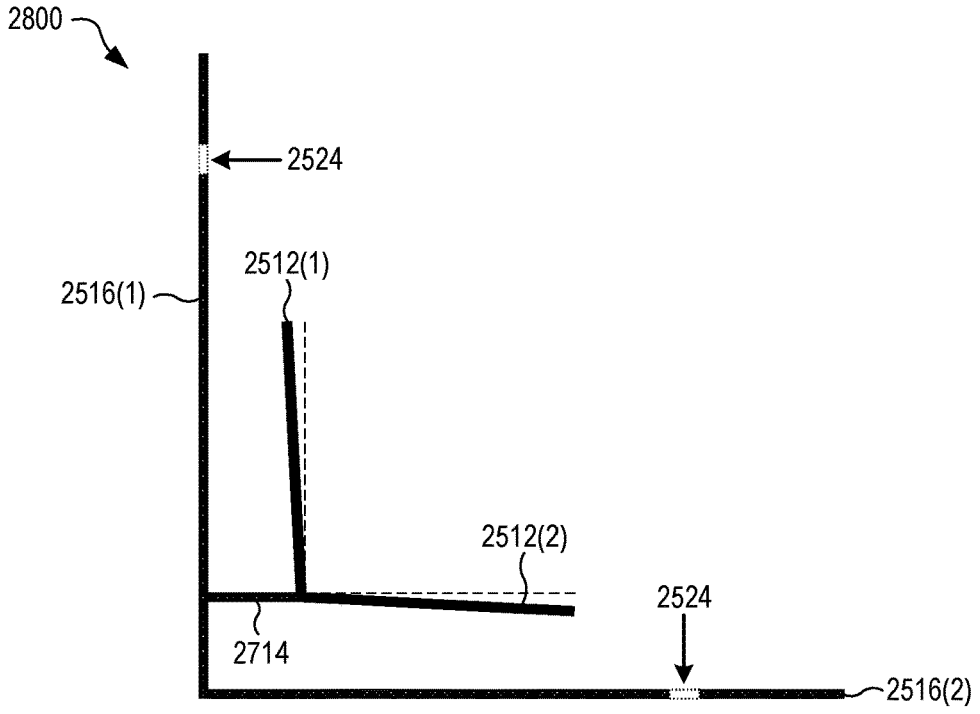
FIG. 28 shows an inside-corner wallboard-fastening device that is similar to the outside-corner wallboard-fastening device of FIG. 27, except configured to secure two wallboards in an inside-corner configuration, in an embodiment.

FIG. 28 shows an inside-corner wallboard-fastening device 2800 that is similar to outside-corner wallboard-fastening device 2700 of FIG. 27, except configured to secure two wallboards in an inside-corner configuration.

Figure 29:
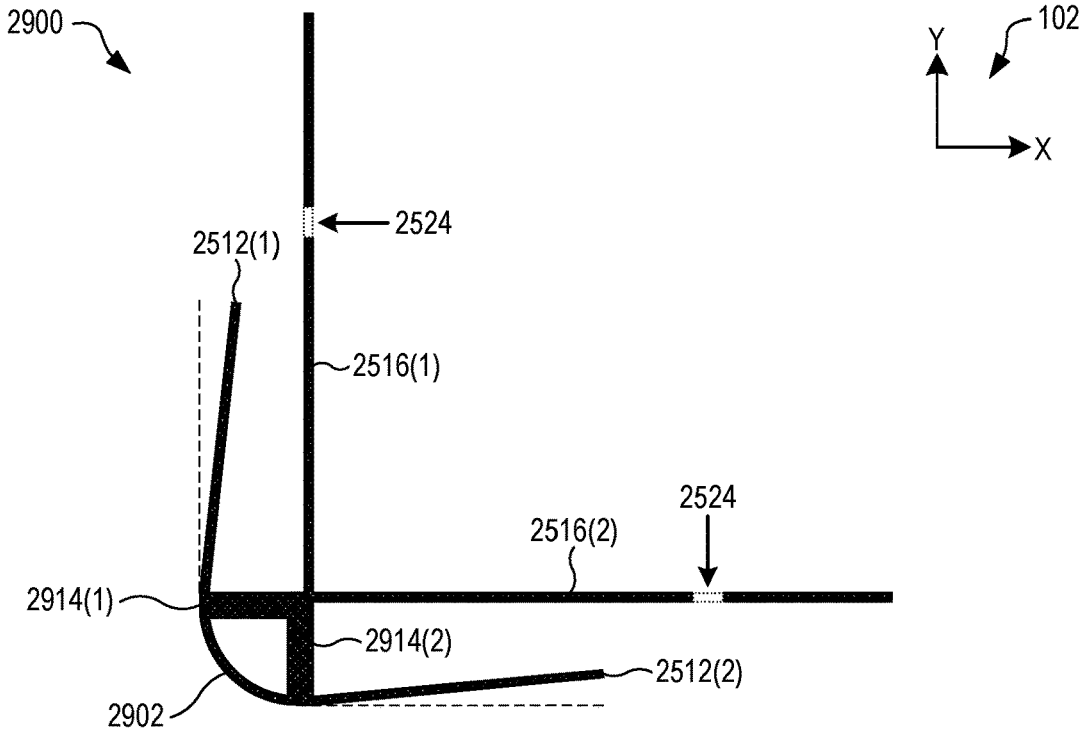
FIG. 29 shows an outside-corner wallboard-fastening device that is similar to the wallboard-fastening devices of FIGS. 13 and 25, except configured with a curved bulldog nose that replaces first and second corner panels, in an embodiment.

FIG. 29 shows an outside-corner wallboard-fastening device 2900 that is similar to wallboard-fastening devices 1300 (see FIG. 13) and 2500 (see FIG. 25), except configured with a curved bulldog nose 2902 that replaces corner panels 1322. Wallboard-fastening device 2900 includes bridges panels 2914(1), 2914(2) that are similar to bridge panels 1314(1), 1314(2) of wallboard-fastening device 1300.

Figure 30:
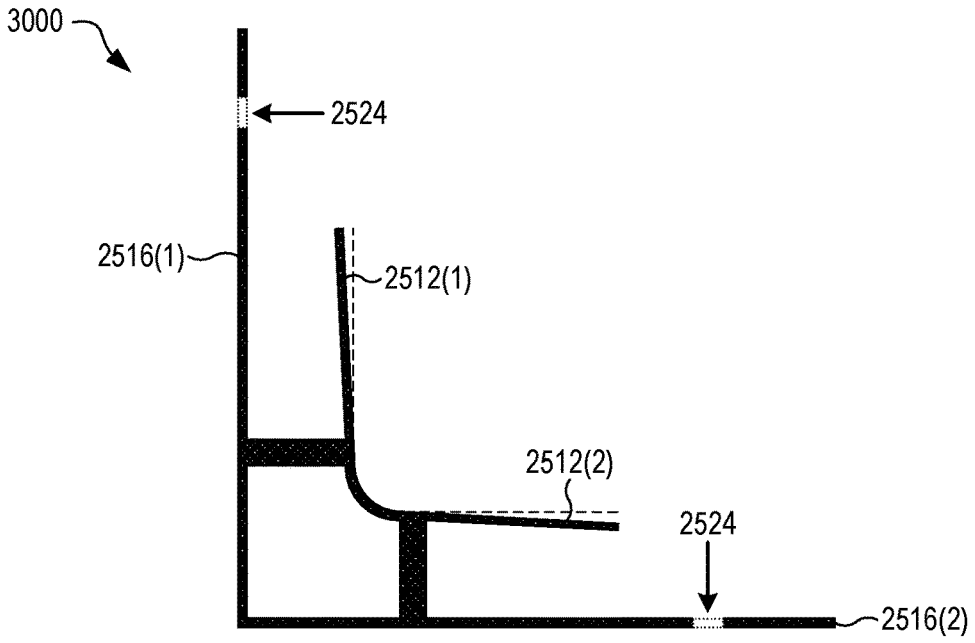
FIG. 30 shows an inside-corner wallboard-fastening device that is similar to the outside-corner wallboard-fastening device of FIG. 29, except configured to secure two wallboards in an inside-corner configuration, in an embodiment.

FIG. 30 shows an inside-corner wallboard-fastening device 3000 that is similar to outside-corner wallboard-fastening device 2900 of FIG. 29, except configured to secure two wallboards in an inside-corner configuration.

Figure 31:
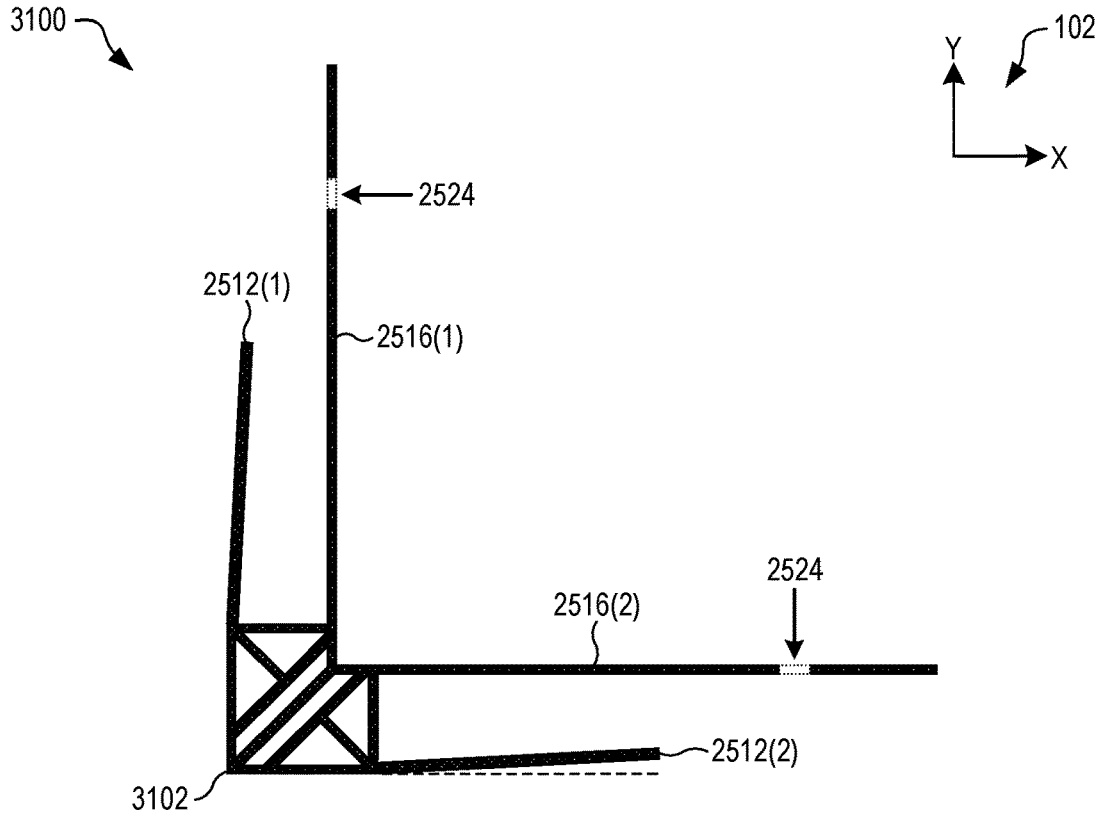
FIG. 31 shows an outside-corner wallboard-fastening device that is similar to the wallboard-fastening device of FIG. 25, except configured with a reinforced nose that strengthens the outside corner, in an embodiment.

FIG. 31 shows an outside-corner wallboard-fastening device 3100 that is similar to wallboard-fastening device 2500 of FIG. 25, except configured with a reinforced nose 3100 that strengthens the outside corner.

Figure 32:
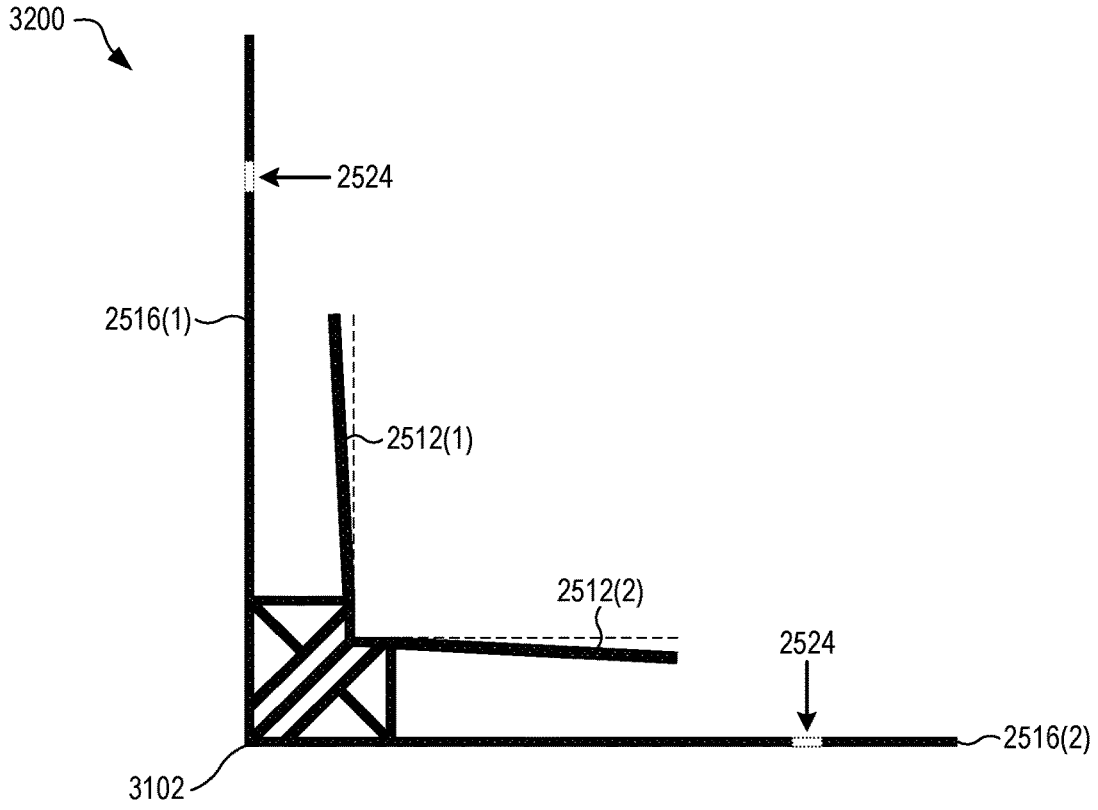
FIG. 32 shows an inside-corner wallboard-fastening device that is similar to the outside-corner wallboard-fastening device of FIG. 31, except configured to secure two wallboards in an inside-corner configuration, in an embodiment.

FIG. 32 shows an inside-corner wallboard-fastening device 3200 that is similar to outside-corner wallboard-fastening device 3100 of FIG. 31, except configured to secure two wallboards in an inside-corner configuration.

Features shown in FIGS. 25-32 may be combined with and/or incorporated into any of wallboard-fastening devices 100, 900, 1100, 1300, 2100, 2300, and other embodiments described herein. For example, either of outside-corner wallboard-fastening devices 1300 and 2100 may be alternatively or additionally configured with one or more of single planar channel-dividing panel 2514 of FIG. 25, bridge panel 2714 of FIG. 27, curved bulldog nose 2902 of FIG. 29, and reinforced corner 3102 of FIG. 31. Similarly, inside-corner wallboard-fastening device 1300 may be alternatively or additionally configured with one or more of single planar channel-dividing panel 2514 (see FIG. 26), bridge panel 2714 (see FIG. 28), curved bulldog nose 2902 (see FIG. 30), and reinforced corner 3102 (see FIG. 32).

Embodiments with Extended Corners

Figure 33:
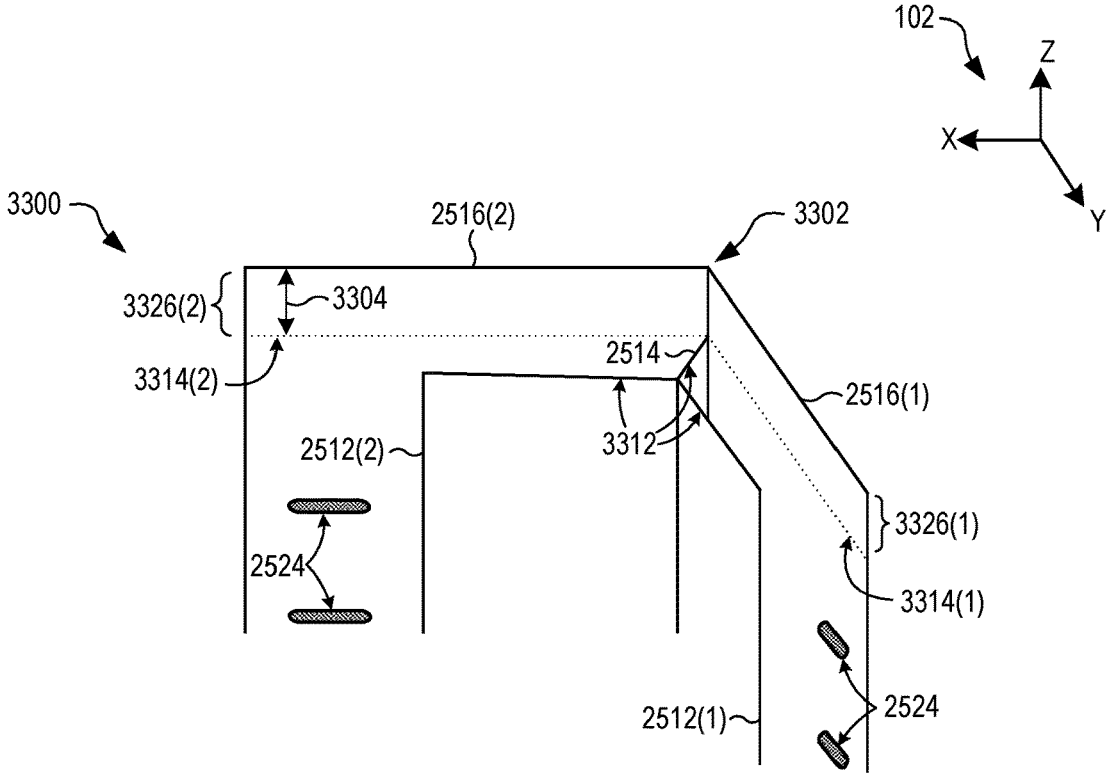
FIG. 33 is an isometric view of an inside-corner wallboard-fastening device with first and second framing panels that form an extended corner, in an embodiment.
Figure 34:
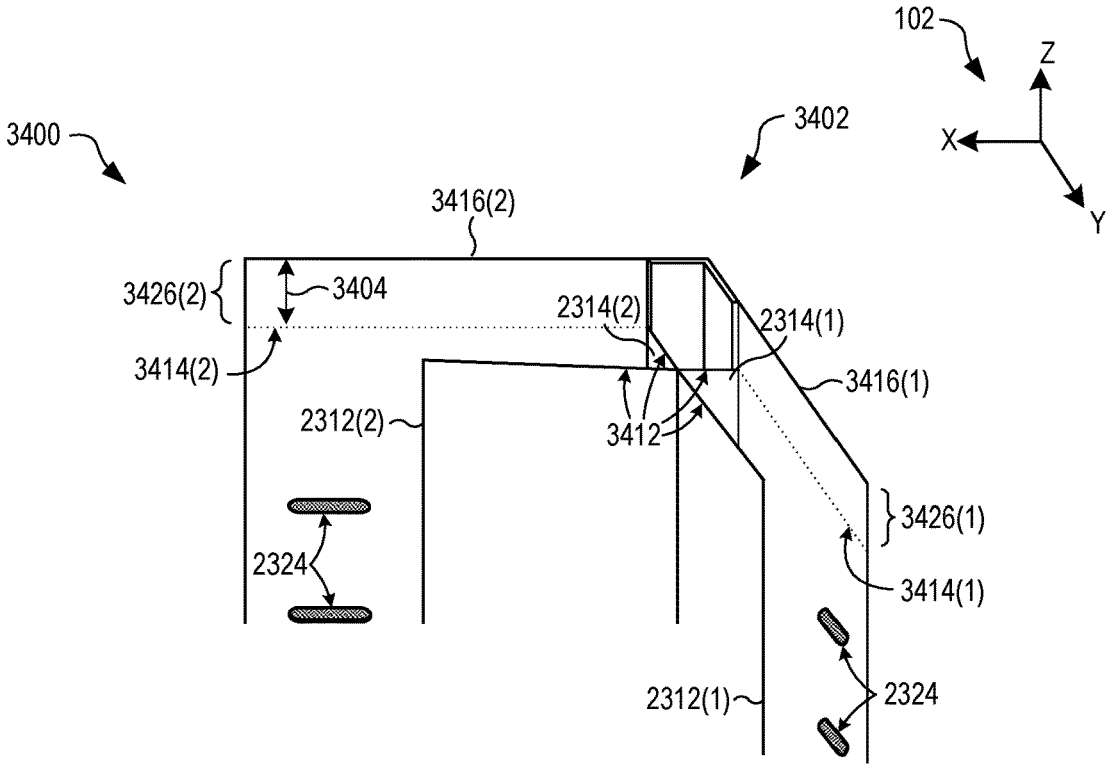
FIG. 34 is an isometric view of an inside-corner wallboard-fastening device with first and second framing panel that form an extended corner, in an embodiment.

FIG. 33 is an isometric view of an inside-corner wallboard-fastening device 3300 with first and second framing panels 2516(1), 2516(2) that form an extended corner 3302. FIG. 34 is an isometric view of an inside-corner wallboard-fastening device 3400 with first and second framing panels 3416(1), 3416(2) that form an extended corner 3402. FIGS. 33 and 34 are best viewed together with the following description.

Inside-corner wallboard-fastening device 3300 of FIG. 33 is similar to inside-corner wallboard-fastening device 2500 of FIG. 25 except that first and second framing panels 2516(1), 2516(2) extend vertically upward (i.e., in the positive z direction; see coordinate system 102) past top edges 3312 of flat-spring flanges 2512 and channel-dividing panel 2514 by an extension distance 3304 to form extended corner 3302. Portions of framing panels 2516 above top edges 3312 form corresponding alignment edges 3326 that may be used to align a ceiling wallboard panel (lying flat in the x-y plane) at the inside corner. Top edges 3312 may physically support the ceiling wallboard panel, and thus extended corner 3304 may form part of a drop-in ceiling system that partially supports a ceiling tile placed thereon. Dashed lines 3314(1), 3314(2) are the projections of top edges 3312 onto first and second framing panels 2516(1), 2516(2), i.e., where top edges 3312 would be located on framing panels 2516 if flat-spring flanges 2512 and channel-dividing panel 2514 were co-planar with framing panels 2516. Extension distance 3304 may be chosen equal to a thickness of the ceiling wallboard panel.

Inside-corner wallboard-fastening device 3400 of FIG. 34 is similar to inside-corner wallboard-fastening device 2300 of FIG. 23 except that first and second framing panels 3416(1), 3416(2) extend vertically upward (i.e., in the positive z direction; see coordinate system 102) past top edges 3412 of flat-spring flanges 2312 and bridge panels 2314 by an extension distance 3404 to form extended corner 3402 and alignment edges 3426. Similar to FIG. 33, dashed lines 3414(1), 3414(2) are the projections of top edges 3412 onto framing panels 3416. Extension distance 3404 may be chosen to equal to a thickness of the ceiling wallboard panel. As shown in FIG. 34, each framing panel 3416 may be thickened in certain locations (e.g., between each bridge panel 2314 and where framing panels 3416 are perpendicularly joined) to add rigidity to the inside corner. Such thickening may also be implemented in similar locations of wallboard-fastening device 3300 of FIG. 33.

From the examples of FIGS. 33 and 34, it should be appreciated that any inside-corner wallboard-fastening device described hereinabove may be similarly configured with an extended corner. Specifically, any wallboard-fastening device described herein may be configured with framing panels that extend vertically upward past top edges of corresponding flat-spring flanges. For example, in FIGS. 13 and 14, any of first, second, and third framing panels 1316, 1318, 1320 of wallboard-fastening device 1300 may extend vertically upward past top edges of first and second flat-spring flanges 1312, first and second bridge panels 1314, and first and second corner panels 1322 to form an alignment edge against which an end of a ceiling wallboard panel may be aligned. In another example, second framing panel 118 of wallboard-fastening device 100 of FIG. 1 extends vertically upward past top edges of flat-spring flanges 112 and a top edge of channel-dividing panel 114 to create an alignment edge.

Embodiments for Tapered Drywall

Figure 35:
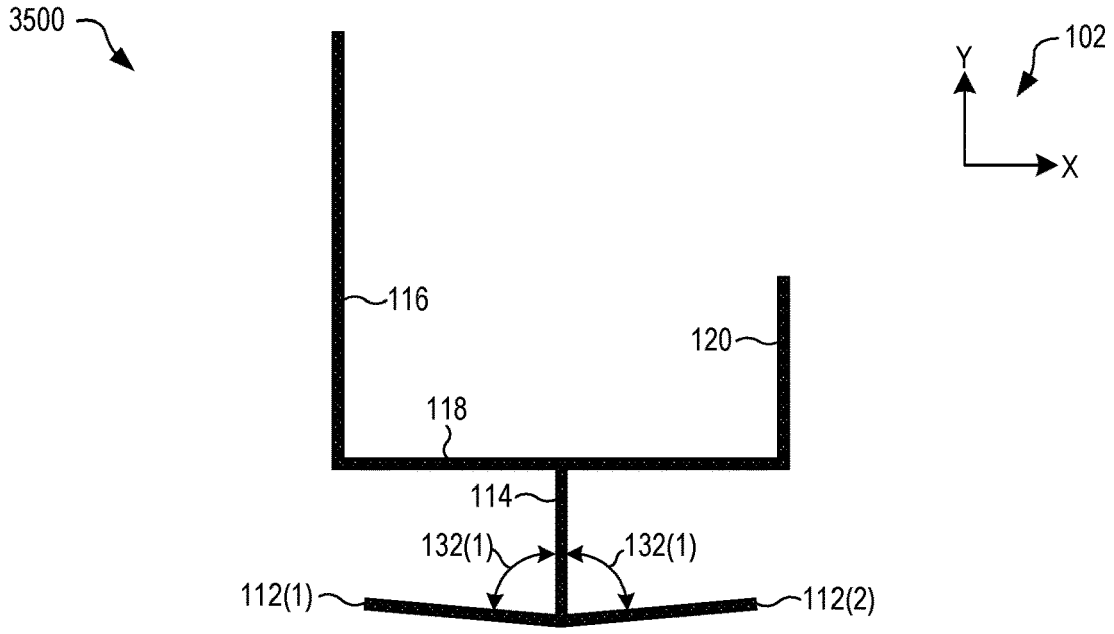
FIG. 35 is an end view of a wallboard-fastening device that secures tapered wallboards to a framing member in the standard edge joint configuration without fasteners passing through the wallboards, in an embodiment.
Figure 36:
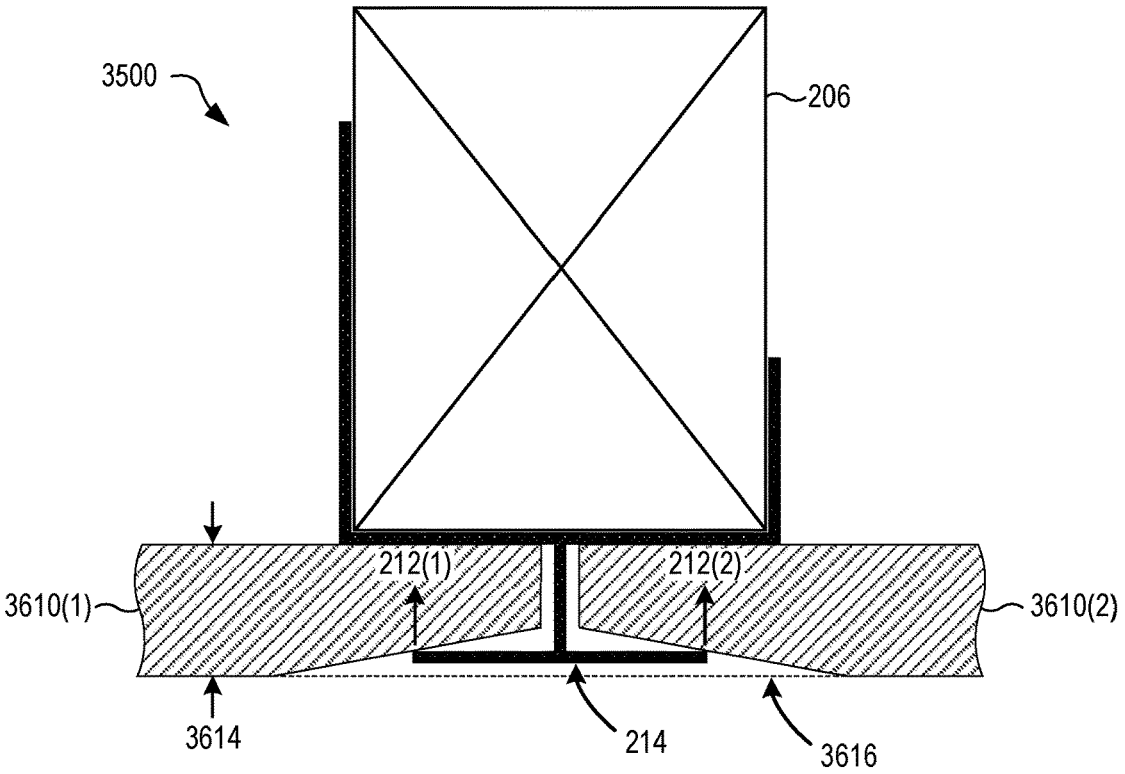
FIG. 36 illustrates the wallboard-fastening device of FIG. 35 securing first and second tapered wallboards to a wall stud in the edge-joint configuration.

FIG. 35 is an end view of a wallboard-fastening device 3500 that secures tapered wallboards to a framing member in the standard edge joint configuration without fasteners passing through the wallboards. FIG. 36 illustrates wallboard-fastening device 3500 of FIG. 35 securing first and second tapered wallboards 3610(1), 3610(2) to the wall stud 206 in the edge-joint configuration. FIGS. 35 and 36 are best viewed together with the following description.

Wallboard-fastening device 3500 is similar to wallboard-fastening device of FIG. 1 except that the width of channel-dividing panel 114 (in the y direction) is less than a nominal width 3614 of tapered wallboards 3610. Accordingly, outward-facing surfaces 214 of flat-spring flanges 112 do not extend (in the negative y direction) past an outer plane 3616 defined by the outward-facing paper-bound edges of tapered wallboards 3610. Outward-facing surfaces 214 may be textured (e.g., with striations) to facilitate the application of mud or joint compound thereon. After sanding/finishing, outward-facing surfaces 214 are hidden beneath the mud, and a continuous outward surface (e.g., at level 5) at outer plane 3616 can be achieved.

In one embodiment of wallboard-fastening device 3500, nominal angle 132(1) is eighty-five degrees, first framing panel 116 has a width of 30 mm, second framing panel 118 has a width of 44 mm, third framing panel 120 has a width of 10 mm, and each of first and second flat-spring flanges 112 has a width of 15.5 mm. Together, flat-spring flanges 112 span 31 mm, less than the 44-mm width of second framing panel 118. Thus, the distal lengthwise edge of each flat-spring panel 112 does not extend past the corresponding lengthwise edge of second framing panel 118 in the x direction. The widths of channel-dividing panel 114 and flat-spring flanges 112 can be selected, based on tapered wallboards 3610, to ensure that outward-facing surfaces 214 do not extend past outer plane 3616, and that flat-spring flanges 112 apply sufficient forces to secure tapered wallboards 3610.

The thickness of flat-spring flanges 112 introduces a tradeoff between the magnitude of spring-restoring forces 212 and a distance in the −y direction where outward-facing surfaces 214 lie. When the thickness of flat-spring flanges 112 is increased, the magnitudes of spring-restoring forces 212 increase. However, if the thickness is increased too much, the force required to pull on flat-spring flanges 112

(e.g., see force 502) may be large enough to impede insertion of tapered wallboards 3610. Flat-spring flanges 112 that are too thick may also have outward-facing surfaces 214 that extend past outer plane 3616, interfering with mudding and finishing. In this case, it may be beneficial to reduce the width of channel-dividing panel 114. In one embodiment, the thickness of each flat-spring flange 112 is 1 mm.

Changes may be made in the above methods and systems without departing from the scope hereof. In particular, the part of any device termed a "flange" as used in the examples above may be perforated, striated, grooved or otherwise treated with a pattern or materials other than PVC/vinyl to achieve characteristics or qualities desired for particular applications. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A wallboard-fastening device for securing first and second wallboards to a framing member, comprising:

a frame comprising first and second framing panels joined lengthwise to each other, the frame being sized to fit against a corner of the framing member where an outward face of the framing member and a side face of the framing member meet, the first framing panel being configured such that one or more fasteners can pass through the first framing panel to secure the first framing panel to the side face of the framing member while the second framing panel contacts the outward face of the framing member;

first and second flat-spring flanges joined lengthwise to each other; and a channel-dividing panel having first and second channel-dividing-panel edges, the first channel-dividing-panel edge being joined lengthwise to one or both of the first and second flat-spring flanges, the second channel-dividing-panel edge being joined lengthwise to the second framing panel to divide the second framing panel into first and second portions;

wherein:

the channel-dividing panel, first flat-spring flange, and first portion of the second framing panel form a first channel sized to receive the first wallboard;

the channel-dividing panel, second flat-spring flange, and second portion of the second framing panel form a second channel sized to receive the second wallboard;

the first flat-spring flange flexes, when the first wallboard is inserted into the first channel, to exert a first restoring force that pushes the first wallboard against the first portion of the second framing panel to secure the first wallboard against the first portion of the second framing panel; and the second flat-spring flange flexes, when the second wallboard is inserted into the second channel, to exert a second restoring force that pushes the second wallboard against the second portion of the second framing panel to secure the second wallboard against the second portion of the second framing panel.

2. The wallboard-fastening device of claim 1, wherein:

the channel-dividing panel is perpendicular to the second framing panel;

the first flat-spring flange forms, when the first wallboard is absent from the first channel, a first angle with the channel-dividing panel that is less than ninety degrees; and the second flat-spring flange forms, when the second wallboard is absent from the second channel, a second angle with the channel-dividing panel that is less than ninety degrees.

3. The wallboard-fastening device of claim 2, each of the first and second angles being eighty-five degrees.

4. The wallboard-fastening device of claim 2, wherein:

the first flat-spring flange forms, when the first wallboard is inserted into the first channel, a ninety-degree angle with the channel-dividing panel;

the second flat-spring flange forms, when the second wallboard is inserted into the second channel, a ninety-degree angle with the channel-dividing panel; and the first and second wallboards are co-planar when inserted into the respective first and second channels.

5. The wallboard-fastening device of claim 1, further comprising a third framing panel joined perpendicularly to the second framing panel to form a three-sided cup sized to fit around the framing member.

6. The wallboard-fastening device of claim 1, wherein:

the channel-dividing panel is joined to a midline of the second framing panel; and each of the first and second flat-spring flanges has a width that is less than one-half of a width of the second framing panel.

7. The wallboard-fastening device of claim 1, the first framing panel forming one or more fastener holes configured such that the one or more fasteners can pass through the one or more fastener holes to secure the first framing panel to the side face of the framing member.

8. The wallboard-fastening device of claim 1, the first framing panel, second framing panel, channel-dividing panel, first flat-spring flange, and second flat-spring flange having the same thickness.

9. The wallboard-fastening device of claim 5, wherein:

the first framing panel is joined perpendicularly to a first lengthwise edge of the second framing panel;

the third framing panel is joined perpendicularly to a second lengthwise edge of the second framing panel; and a width of the first framing panel is greater than a width of the third framing panel.

10. The wallboard-fastening device of claim 1, the first and second flat-spring flanges being free of holes.

11. The wallboard-fastening device of claim 1, wherein:

the first and second wallboards are untapered; and a width of the channel-dividing panel is equal to or greater than a thickness of the first and second wallboards.

12. The wallboard-fastening device of claim 1, wherein:

the first and second wallboards are tapered; and a width of the channel-dividing panel is less than a thickness of untapered sections of the first and second wallboards.

13. The wallboard-fastening device of claim 1, the second framing panel having a width greater than or equal to that of the framing member.

14. The wallboard-fastening device of claim 1, the second framing panel having a width less than or equal to that of the framing member.

15. The wallboard-fastening device of claim 1, wherein:

the channel-dividing panel is joined to a midline of the second framing panel; and each of the first and second flat-spring flanges has a width that is greater than one-half of a width of the second framing panel.

16. The wallboard fastening device of claim 1, formed via extrusion.

17. The wallboard-fastening device of claim 1, comprising plastic.

18. The wallboard fastening device of claim 1, one or both of the first and second flat-spring flanges having an outward-facing surface that is textured.

19. The wallboard fastening device of claim 1, one or both of the first and second flat-spring flanges having an outward-facing surface that is not textured.

20. The wallboard fastening device of claim 1, the first channel-dividing-panel edge being joined lengthwise to both the first flat-spring-flange edge and the second flat-spring-flange edge.

21. The wallboard fastening device of claim 1, wherein:

the first flat-spring flange has a first flat-spring-flange edge; and the second flat-spring flange has a second flat-spring-flange edge joined lengthwise to the first flat-spring-flange edge.

22. The wallboard fastening device of claim 1, wherein:

the first framing panel has a first framing-panel edge; and the second framing panel has a second framing-panel edge joined lengthwise to the first framing-panel edge.

* * * * *